US005788574A

United States Patent [19]

Ornstein et al.

[11] Patent Number: 5,788,574

[45] **Date of Patent: *Aug. 4, 1998**

[54] METHOD AND APPARATUS FOR PLAYING A BETTING GAME INCLUDING INCORPORATING SIDE BETTING WHICH MAY BE SELECTED BY A GAME PLAYER

[75] Inventors: Marvin A. Ornstein, Ocean Springs, Miss.; Richard B. Hanbicki, Three Bridges, N.J.

[73] Assignee: MAO, Inc., Ocean Springs, Miss.

[ * ] Notice: The term of this patent shall not extend beyond the expiration date of Pat. No. 5,570,885.

[21] Appl. No.: 532,965

[22] Filed: Sep. 22, 1995

Related U.S. Application Data

[63] Continuation-in-part of Ser. No. 391,051, Feb. 21, 1995, Pat. No. 5,570,885.

[51] Int. Cl.[6] ..... A63F 1/18; A63F 9/00

[52] U.S. Cl. ..... 463/25; 463/29; 463/12; 273/309

[58] Field of Search ..... 273/138.2, 292, 273/274, 309, 237; 463/12, 13, 25, 29; 40/27.5

[56] References Cited

U.S. PATENT DOCUMENTS

| | | | |
|---|---|---|---|
| 4,570,934 | 2/1986 | Smyth | 273/143 R |
| 4,669,731 | 6/1987 | Clarke | 273/143 R |
| 5,299,803 | 4/1994 | Halaby | 273/148 R |
| 5,393,067 | 2/1995 | Paulsen et al. | 273/292 |
| 5,487,547 | 1/1996 | Hobert | 273/274 |
| 5,538,252 | 7/1996 | Green | 273/306 |
| 5,570,885 | 11/1996 | Ornstein | 463/27 |

FOREIGN PATENT DOCUMENTS

| | | |
|---|---|---|
| 497562 | 1/1992 | European Pat. Off. . |
| 1574235 | 9/1967 | German Dem. Rep. . |
| 1202691 | 3/1967 | United Kingdom . |

OTHER PUBLICATIONS

"Blackjack introduced at Table Mountain", The Fresno Bee, Nov. 10, 1992.

*Primary Examiner*—Benjamin H. Layno
*Attorney, Agent, or Firm*—Louis Weinstein

[57] ABSTRACT

A betting apparatus incorporated into a game of chance enabling a player to make a side bet. A chip receptacle is provided at each player's location of a blackjack table for accepting the side bet. A player's key operated display selects a predetermined number of consecutive wins. A microprocessor cooperating with a sensor identifies the denomination of one or more chips placed in the chip receptacle and, together with a number of consecutive wins selected by the player, displays a payoff amount for a selected number of consecutive wins. The hands are played following conventional rules. The betting receptacle cover seals the chips after completion of a betting phase, under control of the dealer, and signals the beginning of a new game. Each player's location is provided with a Loss button, operated by the dealer when a player loses. A Push button may be provided for each player position when that player has a hand equal in value to a dealer's hand to indicate a tie. The microprocessor adds one to the consecutive win count display when a player wins a game, each time the dealer's game button is operated. When the number of consecutive wins displayed equals the number of consecutive wins selected, an audio/visual alarm indicates a win. Other embodiments incorporate the betting apparatus in all casino games, including table games, slot machines and video games. The chip receptacle may be substituted by a coin receptacle in slot machine and video games.

62 Claims, 13 Drawing Sheets

SEQUENCE OF OPERATION

1. READY TO PLAY
FIG. 5a

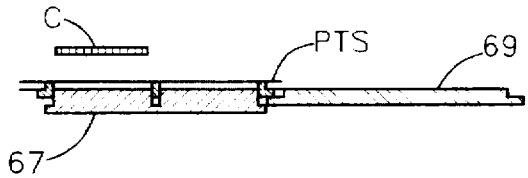

2. 1 TO FOUR CHIPS PLACED INTO DEPRESSIONS
FIG. 5b

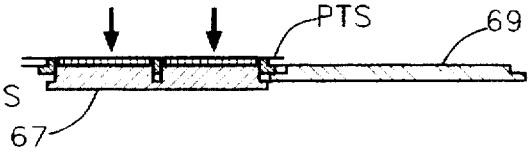

3. CHIPS LOWERED TO ALLOW GLASS PLATE TO COVER THEM
FIG. 5c

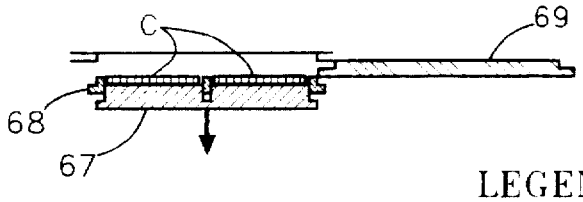

4. GLASS PLATE SLIDES OVER CHIPS TO COVER THEM
FIG. 5d

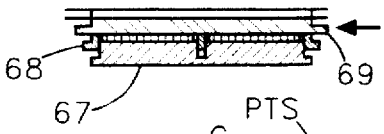

5. PARTS ELEVATE SO THAT GLASS IS FLUSH WITH TABLE SURFACE
FIG. 5e

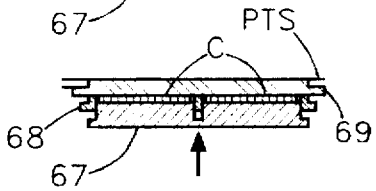

LEGEND

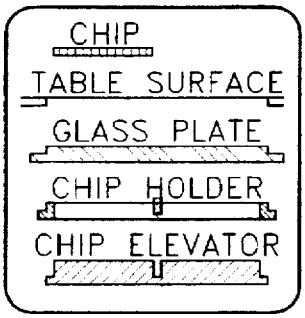

6. PARTS LOWER SO THAT GLASS CAN BE REMOVED
FIG. 5f

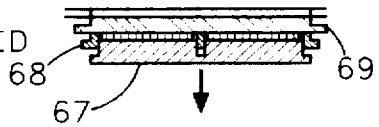

7. GLASS MOVED OUT OF THE WAY
FIG. 5g

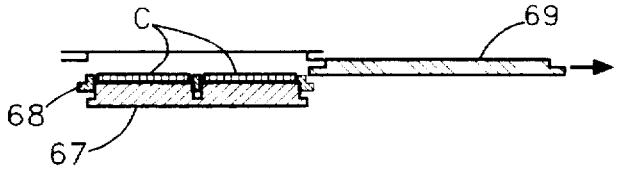

8. PARTS ELEVATE SO THAT CHIPS ARE ABOVE PLAYING SURFACE
FIG. 5h

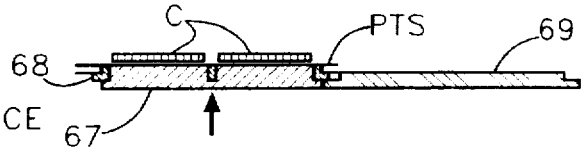

9. GO BACK TO 1 AFTER CHIPS HAVE BEEN REMOVED

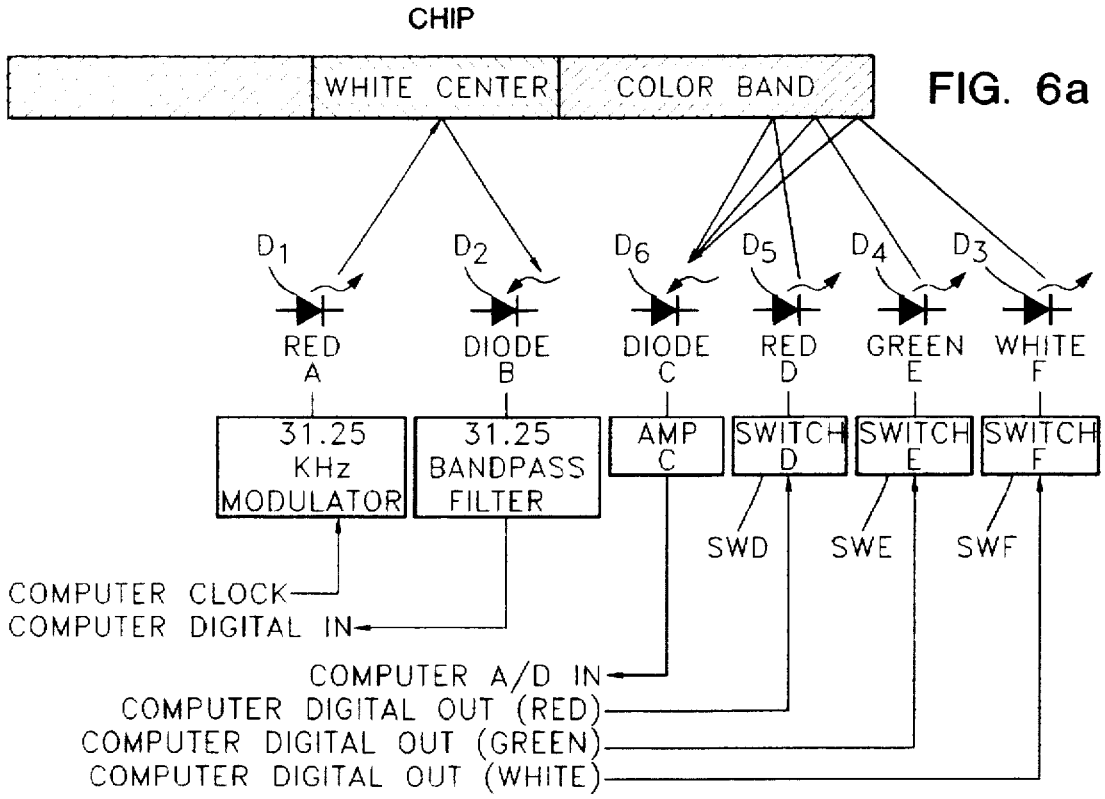
CHIP
WHITE CENTER
COLOR BAND
FIG. 6a
D1
D2
D6
D5
D4
D3
RED A
DIODE B
DIODE C
RED D
GREEN E
WHITE F
31.25 KHz MODULATOR
31.25 BANDPASS FILTER
AMP C
SWITCH D
SWITCH E
SWITCH F
SWD
SWE
SWF
COMPUTER CLOCK
COMPUTER DIGITAL IN
COMPUTER A/D IN
COMPUTER DIGITAL OUT (RED)
COMPUTER DIGITAL OUT (GREEN)
COMPUTER DIGITAL OUT (WHITE)

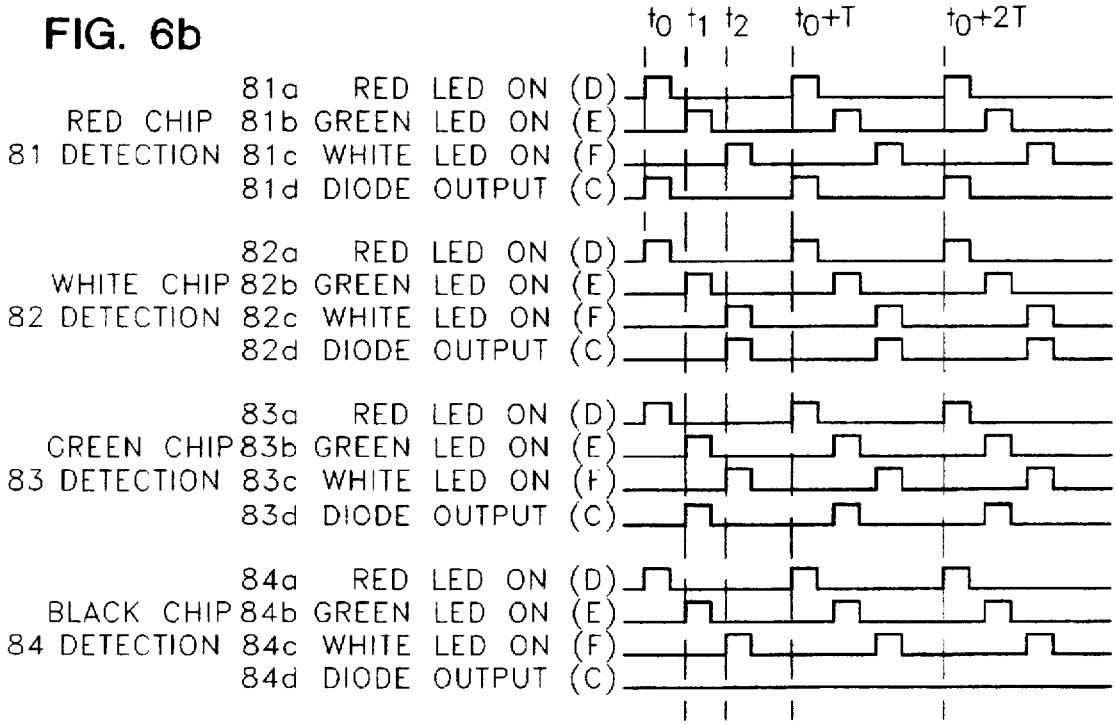
FIG. 6b
t0 t1 t2 t0+T t0+2T
RED CHIP 81 DETECTION
81a RED LED ON (D)
81b GREEN LED ON (E)
81c WHITE LED ON (F)
81d DIODE OUTPUT (C)
WHITE CHIP 82 DETECTION
82a RED LED ON (D)
82b GREEN LED ON (E)
82c WHITE LED ON (F)
82d DIODE OUTPUT (C)
GREEN CHIP 83 DETECTION
83a RED LED ON (D)
83b GREEN LED ON (E)
83c WHITE LED ON (F)
83d DIODE OUTPUT (C)
BLACK CHIP 84 DETECTION
84a RED LED ON (D)
84b GREEN LED ON (E)
84c WHITE LED ON (F)
84d DIODE OUTPUT (C)

LOW HAND WINS
SLOT CHALLENGE

FIVE CARD STUD CHALLENGE

FIVE CARD STUD
POKER SLOT CHALLENGE

METHOD AND APPARATUS FOR PLAYING A BETTING GAME INCLUDING INCORPORATING SIDE BETTING WHICH MAY BE SELECTED BY A GAME PLAYER

This application is a continuation-in-part of application Ser. No. 08/391,051, filed Feb. 21, 1995, now U.S. Pat. No. 5,570,885 entitled Electronic Gaming System for Multiple Play Wagering.

FIELD OF THE INVENTION

The present invention relates to a method and apparatus for playing a betting game and more particularly to novel method and apparatus for playing a betting game having integrated thereto a side bet capability for increasing the betting possibilities and enhancing player interest.

BACKGROUND OF THE INVENTION

As is described in detail in co-pending U.S. application Ser. No. 08/391,051, integration of a side bet capability into conventional betting games adds a totally new dimension to such games which, among other advantages includes the capability of providing a larger selection of possible bets as well as significantly increasing the interest of each game played and the newly created relationship of a consecutive number of wins as a result of the selected side bet which increases the interest of all players at a table, even though some of the players have not chosen to make such a side bet. The nature of the side bet also acts as an inducement to continue play at a given table or slot machine, if the relevant casino requires the player to make the conventional bet before the side bet is allowed. The relevant casino has either option.

BRIEF DESCRIPTION OF THE INVENTION

The present invention is characterized by comprising method and apparatus for integrating a side bet capability into wagering games typically played at casinos and other legal gambling establishments throughout the world.

In one preferred embodiment, side betting is provided in a blackjack game comprised of a blackjack table which accommodates a dealer and a plurality of players. Each player position is provided with a chip receptacle and a key operated, microprocessor-based display. Each player, in addition to making a conventional bet prior to the play of new game, may place one or more chips in a chip receptacle provided at the player's location. Sensors under control of the microprocessor detect the presence and denominations of the chip or chips placed in the receptacle and, together with the number of consecutive wins selected by the player, displays a payoff amount, amount bet, consecutive win number selected and number of consecutive wins attained by each player.

The play begins when the dealer presses a dealer-operated begin game button which automatically covers and seals the chip receptacle while enabling the viewing of the chips through the transparent cover.

Each new game is played in the conventional "21 " manner. When the game in play terminates, the dealer establishes each of the players at the table as winning or losing or tying the dealer's hand. The side bet chips bet by losing players are taken by the dealer either when a player exceeds 21 or when the dealer's total is closer to 21 than the player's. In the event that a player participating in a consecutive win side bet loses a game, the dealer, prior to taking that player's uncovered chips from the table, presses a Loss button on the player's display panel which, in addition to terminating the consecutive win side bet, uncovers the side bet chip receptacle and lifts the chip (or chips) out of the receptacle to facilitate their removal. Once the Loss button is pressed, the displays in front of the relevant player are turned off. The number of consecutive wins presented in a winning player's display participating in a consecutive win side bet is advanced when the dealer presses the game begin button to initiate play of the next hand, unless the dealer has pressed the Push button (player-dealer tie) or the Loss button.

At the option of the relevant casino, the game may include a rule that the player wins if the total of his cards equals the final total of the dealer's cards (i.e. a Push). The Push button will be removed and the payoffs of consecutive wins will be lower than the side bet when neither player or dealer wins with cards of the same total. The lower payoff will incorporate the statistical advantage given to the player when he wins on a "Push".

The side bet chip receptacle remains covered until the occurrence of either a lost hand before the number of consecutive wins selected is achieved or the number of consecutive wins is achieved. The cover prevents the bet from being changed and provides a constant reminder of the consecutive wins side bet as each successive hand is played, regardless of the number of consecutive wins selected by the player. The receptacle cover is transparent to permit easy viewing of the chips in the chip receptacle. The individual microprocessor at each player location automatically locks out the keyboard when the play of the first game following the selection of the consecutive win side bet begins. No change can be made in the number of consecutive wins selected until the player either achieves the number of consecutive wins or has failed to achieve the number of consecutive wins due to a loss of a hand prior to achieving the selected number of consecutive wins.

In other embodiments, the side bet apparatus is integrated into the playing table and/or apparatus. For example, in slot machine embodiments playing video poker, video roulette, video 5-card stud, video low ball poker, video craps, video baccarat, etc. or in slot machines which randomly present one or more sets of three symbols, such as fruit, the key operated display may either be adjacent to or integrated into the slot machine housing for selection of the number of consecutive wins. The slot machine sensors, sense deposit of a coin or coins for the side bet, in addition to the deposit of a coin or coins for a single play. The sensor cooperates with the microprocessor to display the payoff amount selected by the player in the event that the player achieves the selected number of consecutive wins.

The machine, upon completion of a game, automatically terminates the consecutive wins side bet in the event that a loss occurs before achieving the number of consecutive wins. Each time a new game is initiated and, assuming that there has been no intervening game which the player has lost, the number of consecutive wins displayed is incremented by one, the constant updating apprising the player of his progress during the side bet period.

In casinos permitting a consecutive wins bet to be made without betting on a hand, the "side bet" becomes the only bet.

OBJECTS OF THE INVENTION

It is therefore one object of the present invention to provide a novel method and apparatus for enhancing the interest and excitement in a game of chance by incorporating a consecutive wins bet capability, the selection of which is totally at the whim of and under control of a player. The relevant casino or legal gaming establishment will determine the number of consecutive wins to be offered to the betting public.

Still another object of the present invention is to provide novel method and apparatus for enhancing the interest and excitement in a game of chance through the incorporation of a side bet capability permitting a player to select a variable number of consecutive wins and wherein the game of chance may include anyone of blackjack, craps, roulette, baccarat, five card stud, poker, low ball poker played either at a table or video or other types of slot machines.

Still another object of the present invention is to provide novel method and apparatus for enhancing the interest and excitement in a game of chance through the incorporation of a betting capability permitting a player to select a variable number of consecutive wins and wherein the game of chance may include anyone of blackjack, craps, roulette, baccarat, five card stud, poker, low ball poker played either at a table or video or other types of slot machines.

Still another object of the present invention is to provide novel method and apparatus which integrates a side bet capability into a game of chance and which includes providing each player with a display of the number of consecutive wins selected, the amount bet, the number of consecutive wins attained by the player and the payoff amount as a function of the number of consecutive wins displayed and the amount of a bet.

Still another object of the present invention is to provide novel method and apparatus for integrating a side bet capability into a game of chance which utilizes a chip receptacle for receiving and covering chips bet in a consecutive win side bet with a transparent cover to provide an constant, observable reminder of the amount bet and provide a secure system to prevent player dishonest and/or player/dealer collusion by eliminating any opportunity to add or remove chips during play.

Still another object of the present invention is to provide a consecutive wins betting capability in a game of chance in which means are provided to prevent a payoff amount and/or number of consecutive wins selected to be changed once selected to prevent player dishonest and/or player/dealer collusion.

Still another object of the present invention is to provide novel method and apparatus for integrating a side bet capability into a game of chance and which utilizes a chip receptacle for retaining chips therein during the number of plays occurring over a side bet period and for uncovering and dispensing the covered chips upon either the successful completion of a selected number of consecutive wins or a loss occurring before the number of consecutive wins is achieved.

Still another object of the present invention is to provide a novel method and apparatus for integrating a side bet capability into a game of chance played on a slot machine or video game.

Still another object of the present invention is to provide novel method and apparatus for integrating a side bet capability into a game of chance presided over by a dealer and in which the design of the system is such as to minimize the added functions performed by a dealer due to the integration of the side bet capability into the game of chance.

BRIEF DESCRIPTION OF THE FIGURES

The above as well as other objects of the present invention will become apparent when reading the accompanying description and drawings in which:

FIGS. 5*a*–5*h* are simplified views showing various stages of the chip receptacle, chip elevator and transparent cover plate and which is useful in explaining the sequence of operation thereof.

FIG. 6*a* shows a simplified circuit diagram of the chip detection/denomination circuitry.

FIG. 6*b* shows a plurality of groups of waveforms useful in explaining the operation of the circuitry of FIG. 6*a*.

DETAILED DESCRIPTION OF THE INVENTION AND PREFERRED EMBODIMENTS THEREOF

Figure 1:
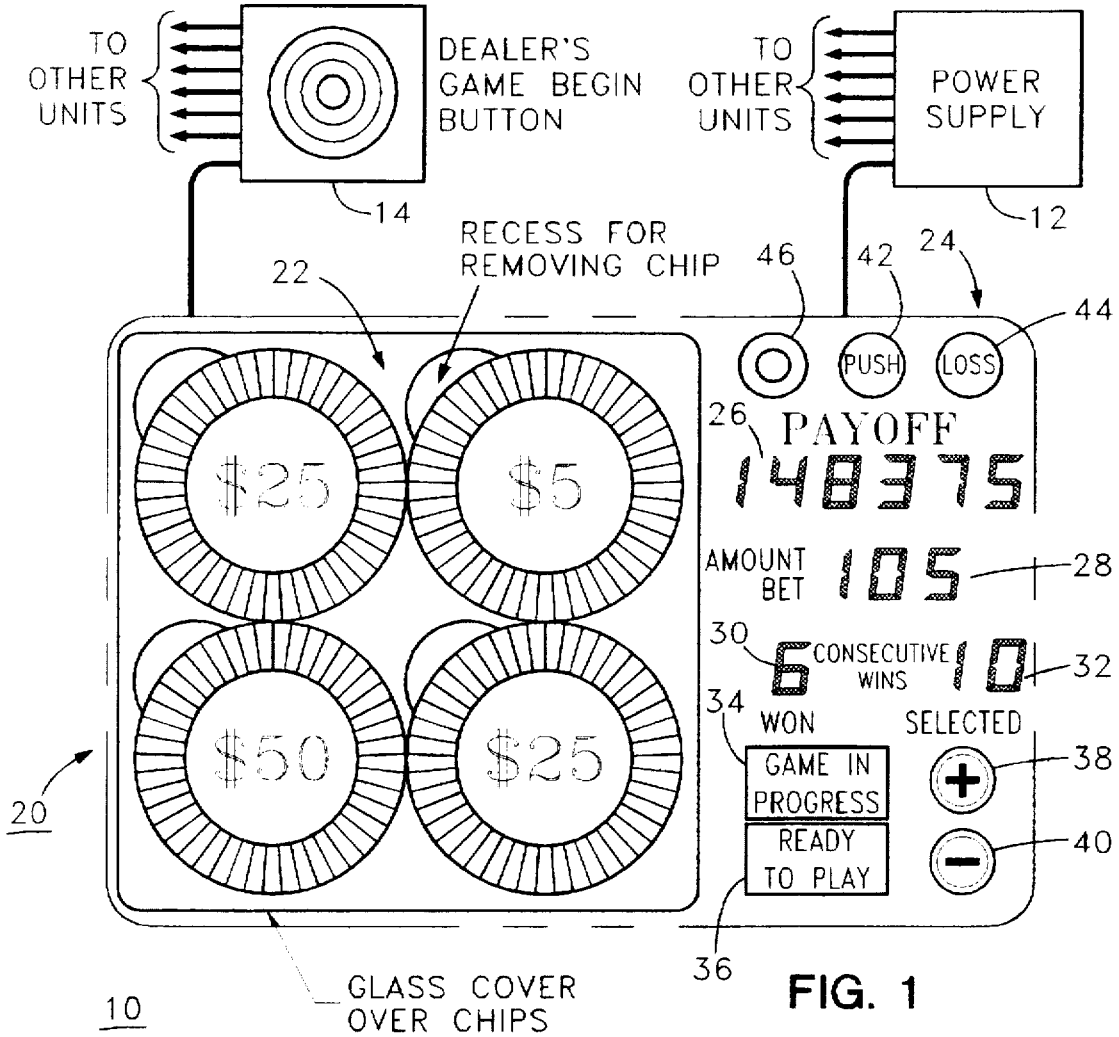
FIG. 1 is a plan view of a side bet layout for a single player which is designed in accordance with the principles of the present invention and further showing the manner in which the players side bet unit interfaces with the dealers game begin button.

FIG. 1 shows a plan view of the side bet layout 10 embodying the principles of the present invention. The side bet layout 10 may be employed in any one of a variety of different games of chance such as for example, blackjack.

Making reference to copending application Ser. No. 08/391,051 which is incorporated herein by reference thereto, a blackjack table layout is shown in FIG. 1 thereof, reference being made thereto for purposes of brevity. In place of the touch screen computer interface 22 shown therein, each player's position 12 is provided with a rectangle 15 at which a player's side bet unit 20 is located.

For the sake of simplicity, only one player's side bet unit is shown in FIG. 1, it being understood that a plurality of such side bet units are provided, one for each player's position 12.

Each side bet unit 20 is coupled to a common power supply 12 and a dealer's game beginning button 14, the power supply 12 and dealer's game begin button 14 being coupled to each other player's side bet unit through the connections as shown.

Since all of the player's side bet units are identical in both design and function, only one unit, namely, the unit 20 of FIG. 1, will be described herein in detail.

The side bet unit 20 includes a chip receptacle 22 and a key operated LCD (or LED) display unit 24 comprised of a payoff display 26 an amount bet display 28, a number of consecutive wins display 30 and a number of consecutive wins selected display 32 as well as a game in progress display 34 and a ready to play display 36.

Each side unit bet 20 is further provided with "+" and "–" push buttons 38 and 40 as well as a Push key 42 and a Loss key 44.

A player's side bet unit 20, briefly, operates in the following manner:

Prior to the play of a new game and assuming that a player is not already engaged in a consecutive win side bet, chip receptacle 22 is open for the receipt of up to four chips of any denomination. The player at side bet unit 20 selects the number of consecutive wins by operating buttons 38 and 40 to respectively either increase the number or decrease the number of consecutive wins selected, which is displayed at 32.

It being understood that a player is also obliged to place a wager on the game itself preparatory to beginning a play and assuming that all of said wagers of the players at the table have been completed, the dealer presses the game begin button 14 causing the chips in the receptacle 22 to be lowered and a transparent cover to seal the receptacle, preventing removal of the chips while at the same time permitting their unobstructed observation.

As an alternative, the relevant casino may choose to allow the side bet without the player making the conventional bet. If so, the player is dealt cards as if he had made the conventional bet. The "side bet" then becomes the only bet.

The ready to play display 36 which need only be a backlit panel having the words "READY TO PLAY" imprinted or otherwise provided thereon and which is illuminated when a previous game has been completed, and the transparent cover is removed from the chip receptacle turns off when the dealer's game button 14 is depressed. Display 34 which may also be simply a backlighted panel that lights up to indicate that the game is in progress. Presuming that this is the start of the first game at which the player has made a consecutive win side bet, display 30 will read "0" while display 32 displays a number of consecutive wins selected by the player. The payoff display indicates the payoff, which is a function of the number of consecutive wins selected and the amount bet. As soon as the dealer's game button 14 is depressed, the microprocessor controlling side bet unit 20 locks out keys 38 and 40, which keys remain locked out until either the number of consecutive wins in display 32 is achieved or in the event that there is an intervening loss of a game prior to reaching the number of consecutive wins selected. The transparent cover is also placed over the chip receptacle.

The play of the blackjack game proceeds in a conventional manner, players winning being paid off while the chips of losing players are removed from the table by the dealer.

The dealer presses the Loss button 44 of the player's side bet unit in the event that the player has lost a game. If the number of consecutive wins has not been achieved because a loss occurs, the microprocessor associated with the player's side bet unit 20 terminates the side bet, uncovers the chip receptacle 22 and elevates those chips in the receptacle to a level above the table to permit their removal.

Assuming that a player at side bet unit 20 has won a hand, upon occurrence of the play of the next game which is initiated by each player providing a wager for the game, the dealer operates the game begin button 14 which automatically advances the number of consecutive wins presented in display 30, however, if the dealer has pressed the Push button 42 because the totals of the dealer and player hands are equal, the number of consecutive wins presented in display 30 will not increase after the game begin button 14 has been pressed by the dealer. As indicated above, the relevant casino may include a rule that the player wins the "Push" or tie. If so the Push button 42 is removed, ignored or disconnected from the controller and payoffs of consecutive wins are reduced to incorporate the statistical advantage otherwise given to the player. The subsequent games are played in a similar manner.

Assuming that the player at unit 20 has achieved the selected number of consecutive wins, the microprocessor associated therewith will present the same numbers in display 30 and 32 and simultaneously therewith will provide, by means of either an alarm or a visual means or both, that a side bet has been won. For example, an audible alarm can be accompanied by flashing one, more than one or all of the displays on the side bet unit. Depending upon the amount and depending upon whether a tax I.D. number is required, the payoff will be performed either at the game table or at a separate payoff station within the casino.

A limited access female receptacle 46 which may receive a male plug of a hand-held unit (not shown) carried by the supervisor or other like personnel, may be plugged into female receptacle 46 in the event that an error has occurred. For example, assuming that a player has won a hand and the Loss button 46 or Push button 42 is accidentally depressed, a supervisor may then be called over to rectify the situation by plugging in the male plug of the portable unit carried by the supervisor to permit resetting of the side bet unit 20 to indicate the proper number of wins and the number of selected wins as well as the payoff number. The payoff amount and number of selected consecutive wins cannot be changed, however.

Figure 1A:
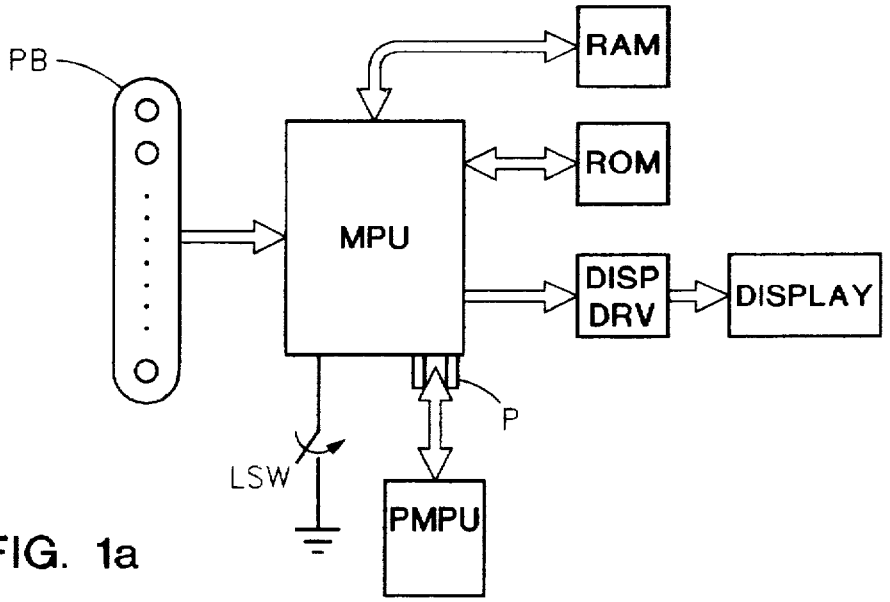
FIG. 1*a* is a block diagram of the controller means for operating each betting unit of the type shown in FIG. 1.
Figure 1B:
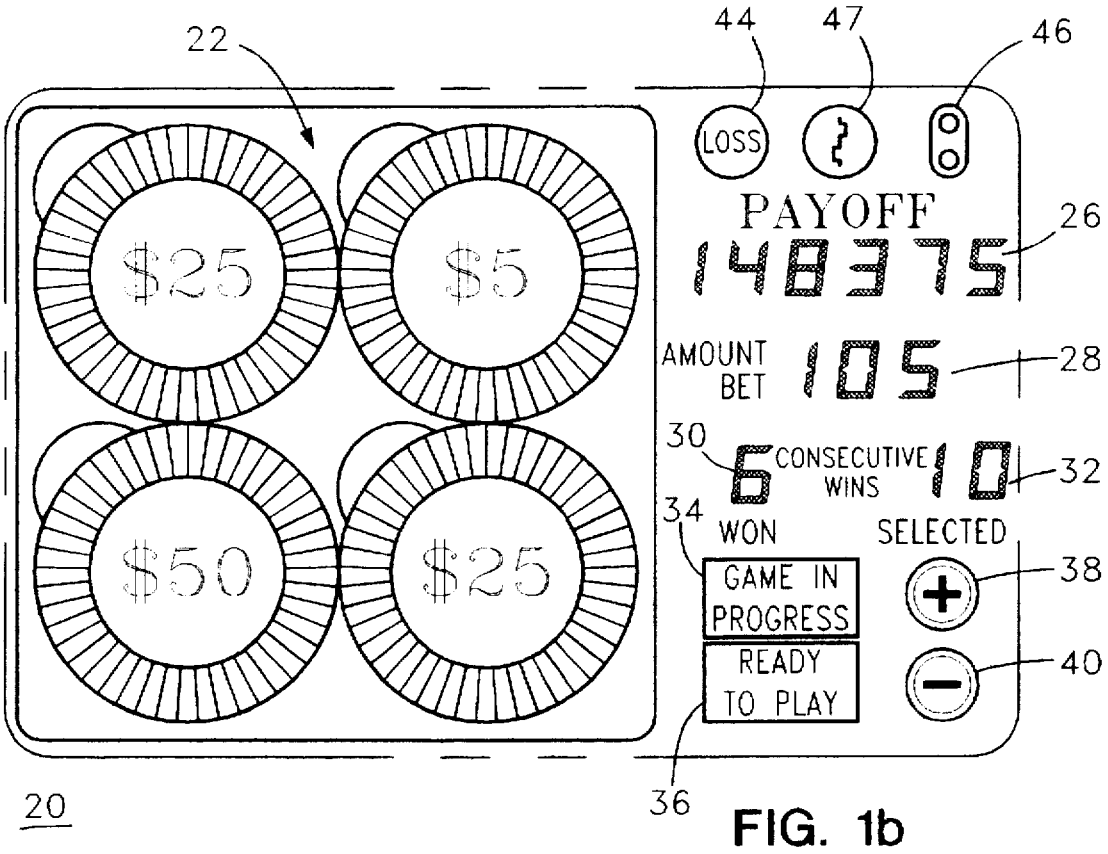
FIG. 1*b* is a plan view showing an alternative arrangement of the unit of FIG. 1.

The controller as shown in FIG. 1*a* which may include a microprocessor MPU, random access memory RAM, read-only memory ROM, push button unit PB and display driver DSPLYDR for driving the Display, is provided with a port P for receiving a male plug of a portable remote unit PMPU for transferring data collected in memory, such as RAM, of all transactions per 8-hour shift, per dealer's shift, etc. to evaluate profitability, efficiency, etc. As an alternative or in addition to, port P at switch LSW which is normally locked and requires a key held by a supervisory is opened (i.e. turned on) to cause the MPU to display the total number of games, total amount of bet, and total amount paid out; for each game, the consecutive wins selected, the amount of bet of each game, the payoff of each win and number of games played before loss; and the serial number of the system.

Once all of the numbers have been captured, the registers will be set to zero. The date and time will be maintained in the hand-held device PMPU and will be appended to the record downloaded from a unit 20. These records, now stored, in the hand-held device, may be downloaded to a separate computer system for analysis and reporting.

Figure 1C:
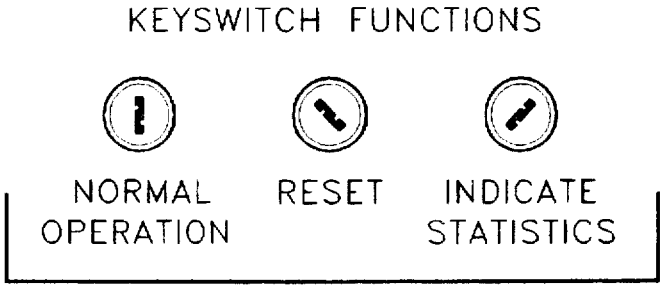
FIG. 1*c* shows the positions to which the keyswitch of FIG. 1*b* can be set.

FIG. 1*c* shows an electrical connector 46 and a key switch 47 selectively moveable to the positions shown in FIG. 1*d*. Either or both of these could be used. In the case of the key switch, the relevant numbers could be displayed on the displays on the system and controlled by the + and – buttons. The numbers are observed and manually recorded, as set forth above. The key switch is also used for resetting the system if an error in play occurred such as an inadvertent push of the Loss button. The pit boss would only have to carry a key rather than a more bulky hand-held electronic device. The switch LSW (FIG. 1*a*) is closed when the key is moved to the data read-out position shown in FIG. 1*c*.

FIGS. 2*a*–2*d* show the chip receptacle and the operating mechanism therefor in greater detail.

Chip receptacle 22 is comprised of a motor 47 having a worm 48 mounted upon its output shaft 47*a*. The shaft of motor 47 extends in the opposite direction and through an opening in one wall of an enclosure 49 housing motor 47 as well as the other components of side bet unit 20, the shaft portion 47*b* being provided to receive a hand crank (not shown for purposes of simplicity) to manually operate the chip receptacle in the event of a power failure or the like.

Worm 48 meshes with a worm gear 50 adapted to rotate about the vertical axis of shaft 51 which is freewheelingly mounted within appropriate openings of a pair of arms of a substantially C-shaped support 52 by means of bearings 53 and 54. Worm gear 50 is secured to shaft 51 by a set screw 50*b* provided in integral collar 50*a* of worm gear 50.

A cam 55 is also mounted upon shaft 51 and is secured thereto by a set screw 55*b* provided in integral collar 55*a* of cam 55. A push rod 56 is slidably mounted within a bore 58*a* provided within a supporting block 58.

A cam follower 57 has a tapered portion thereof slidably engaging the periphery of cam 55. Cam follower 57 extends into a bore 56*a* within push rod 56. A spring 59 arranged within bore 56*a* pushes against the right-hand end of cam follower 57 which provides a resilient mount therefore.

The right-hand end of push rod 56 (see FIG. 2*d*) bears against a "knee" formed between a pair of H-shaped levers 60, 61 which are joined at the aforesaid "knee" by a pin 62, as shown. The right-hand end of H-shaped member 61 is swingably mounted to a bearing block 63 for movably supporting the chip elevator shaft 64 which extends through bores 63*a* and 63*b* provided in bearing block 63. The swingable mount between lever 61 and bearing block 63 comprises a pair of pivot pins 65*a*, 65*b* arranged on opposite sides of bearing block 63 (pin 65*b* being obscured from view in FIG. 2*d*).

Upper H-shaped lever 60 is secured to the elevator shaft 64 by pivot pin 66.

A platform 64*a*, which is integrally joined to the upper end of shaft 64, presses against the elevator platform 67 selectively raising and lowering same.

The lower end of bearing block 63 has a projection 63*c* which extends in an opening within a floor 49*b* of enclosure 49.

Figures 2A, 2C:
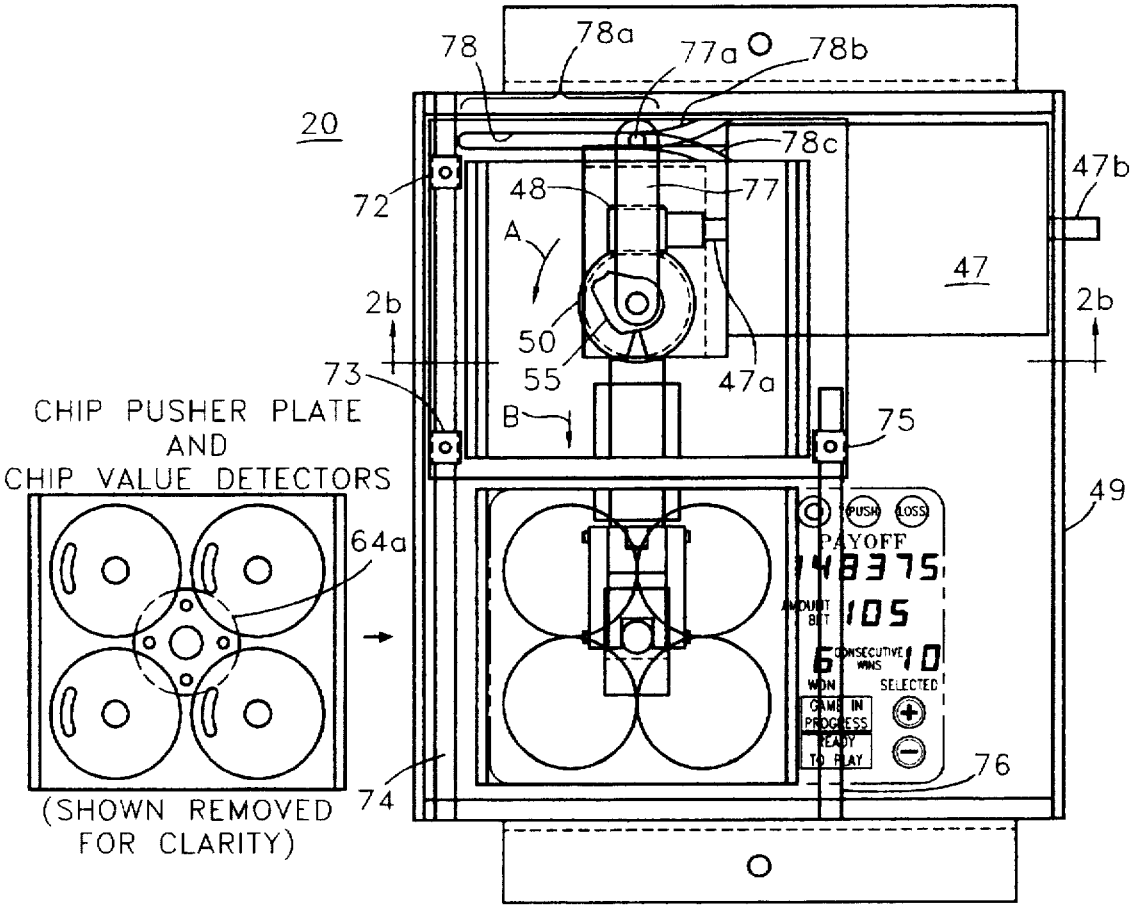
FIG. 2*a* shows a top plan view of the electromechanical mechanism utilized to operate the chip receptacle forming part of a player's side bet unit as shown in FIG. 1.
FIG. 2*c* shows a top plan view of the chip receptacle portion of the player's side bet unit of FIGS. 1 and 2*a*, showing a manner in which the presence and value of a chip is determined.
Figure 2B:
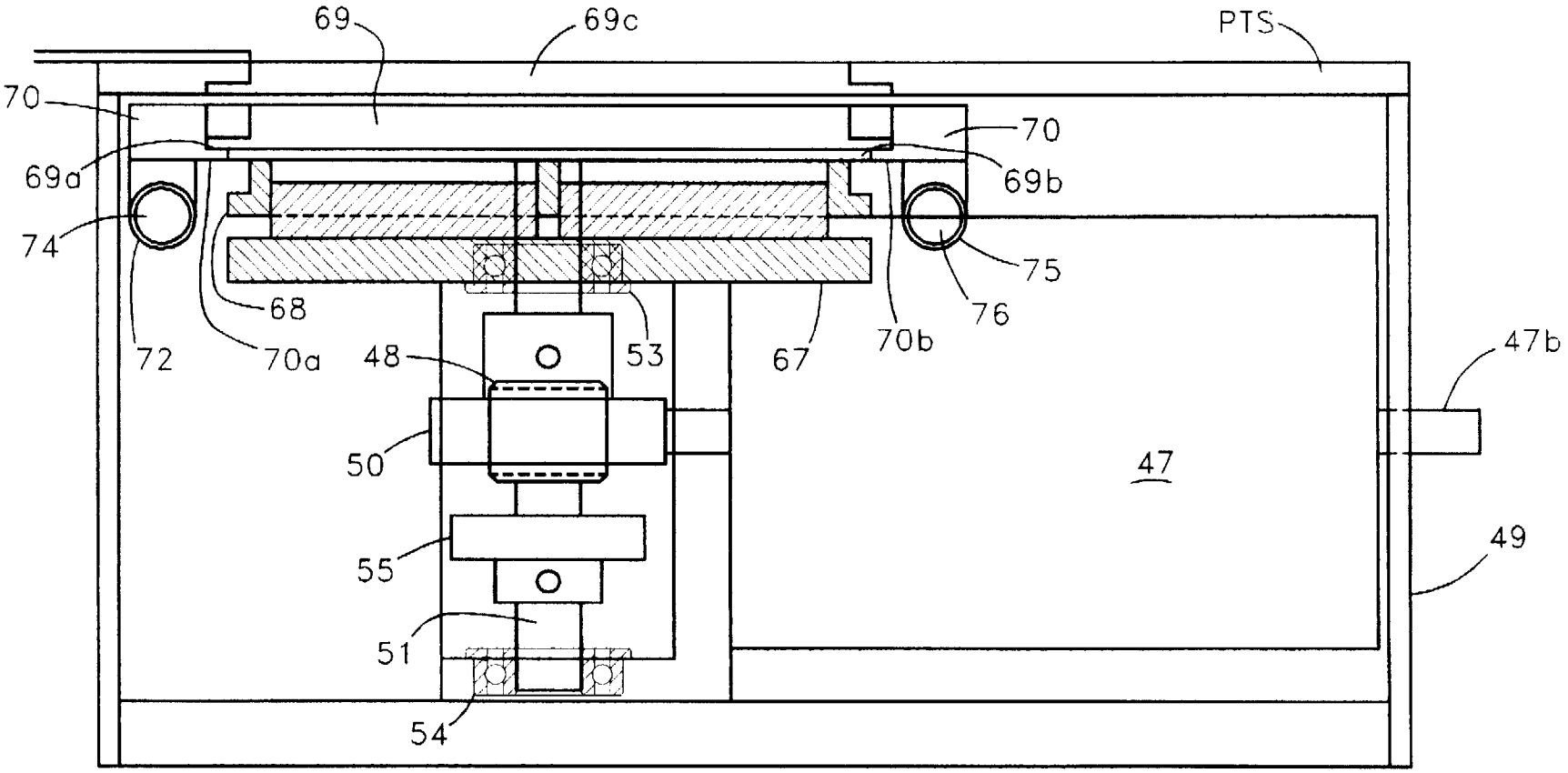
FIG. 2*b* shows a view of the portion of the mechanism shown in FIG. 2*a* looking in the direction of arrows 2*b*14 2*b*.
Figure 2D:
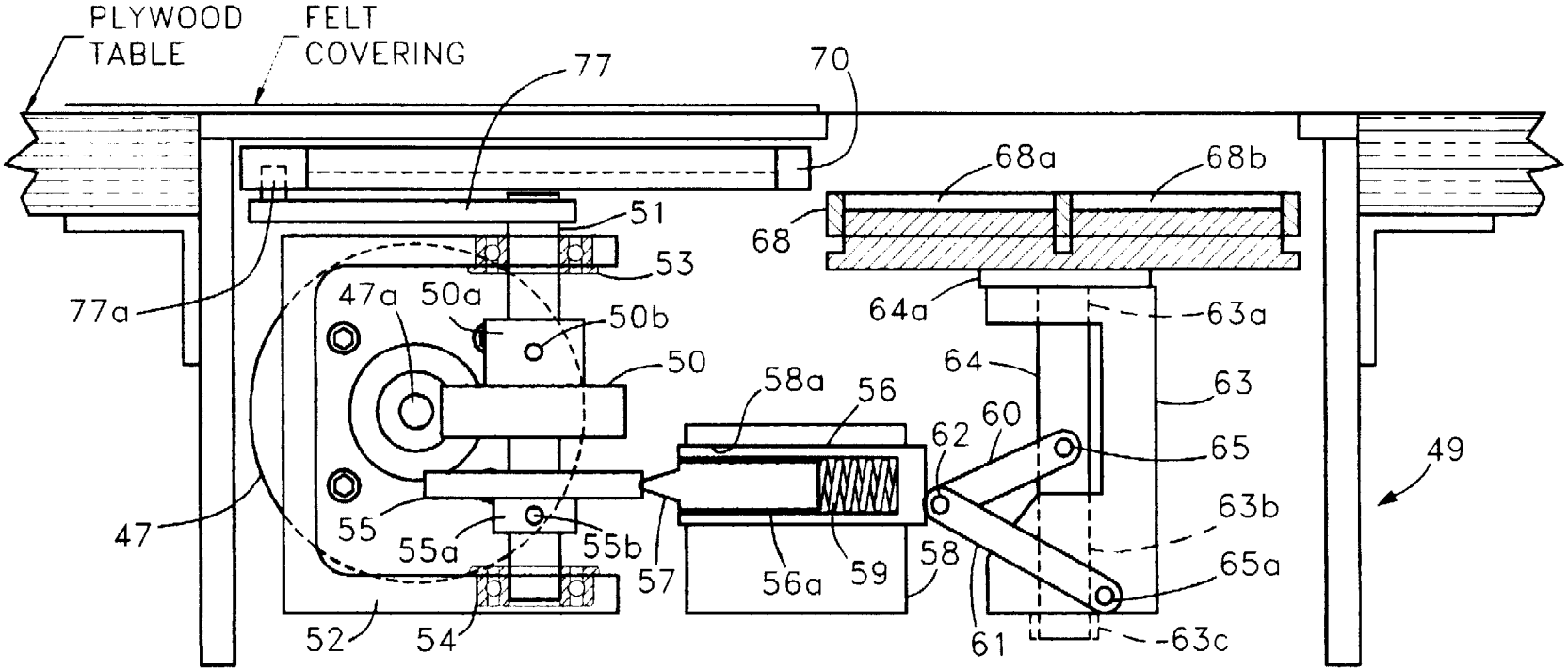
FIG. 2*d* shows a portion of the player's side bet unit of FIG. 2*a* looking in the direction of arrows 2*d*–2*d*.
Figure 4:
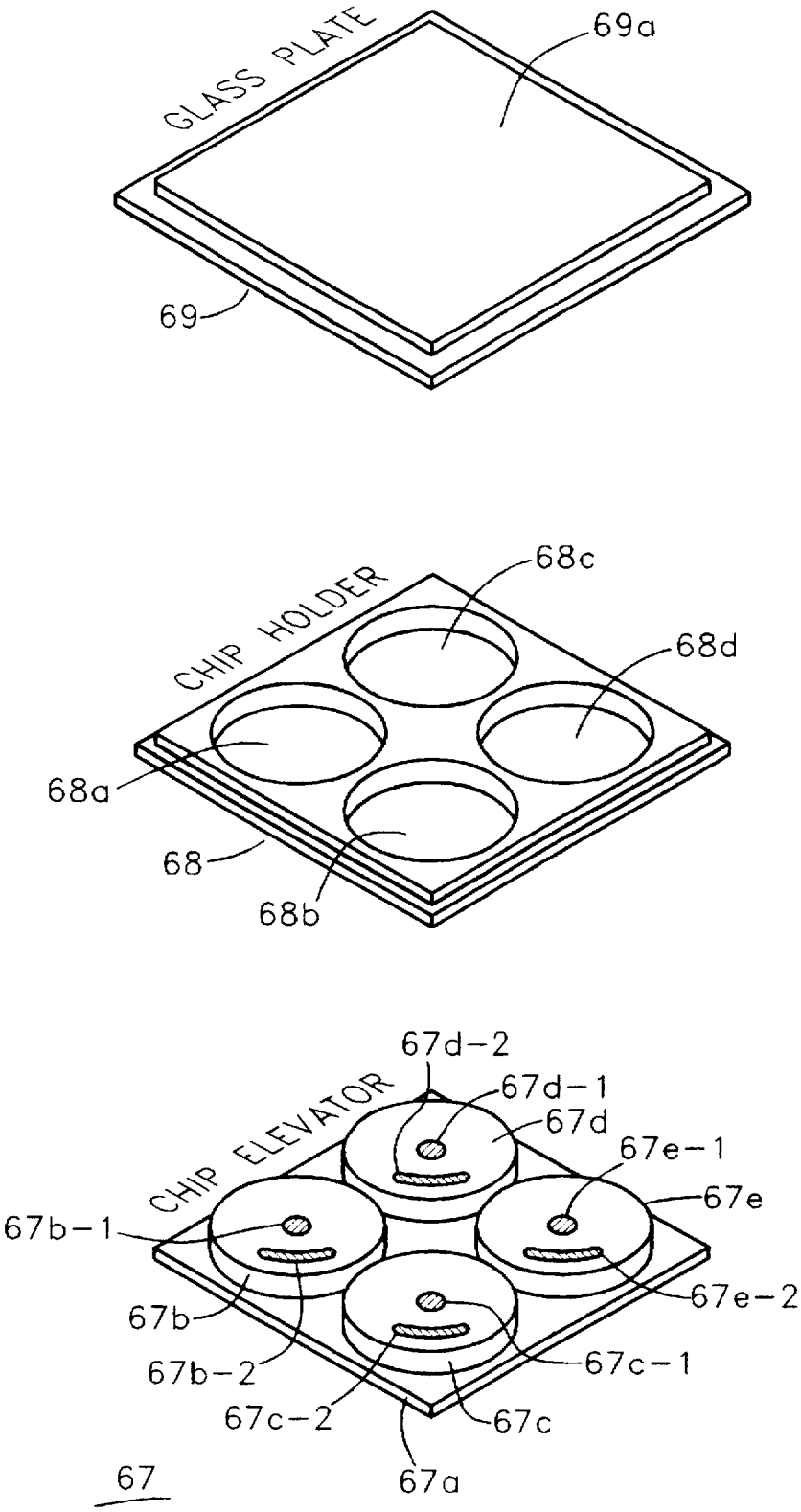
FIG. 4 shows an exploded perspective view of the chip elevator, chip holder, and glass cover plate to further clarify the operation thereof.

Elevator platform 67 is shown in greater detail in FIG. 4 and is comprised of a substantially planar support sheet 67*a* having integrally joined thereto, such as, for example, by an epoxy or suitable adhesive or glue, a plurality of disc-shaped projections 67*b* through 67*e* adapted to selectively extend through openings 68*a*–68*d*, respectively provided within a chip holder member 68. A glass or transparent plastic plate 69 is slidably moveable over chip holder 68 and is arranged to be carried by a supporting frame 70 guided by a pair of guide rods 74 and 75 arranged in spaced parallel fashion as shown in FIGS. 2*a* and 2*b*. Frame 70 has an inwardly directed flange 70*a* as shown in FIGS. 2*a* and 2*b*. Notches 69*a* and 69*b* provided in transparent member 69 rest on flanges 70*a*, 70*b* as shown in FIG. 2*b*. Frame 70 is provided with a pair of hollow cylindrical sleeves 72, 73 which slidably receive elongated guide rod 74. A third hollow sleeve 75 slidably receives a shorter guide rod 76 (see FIG. 2*a*).

A drive arm 77 (FIGS. 2*a* and 2*d*) has one end thereof fixedly secured to the upper end of shaft 51. A drive pin 77*a* is secured to the opposite end of drive arm 77 and rides within an elongated groove 78 in carrier 70 groove which has a straight portion 78*a* joined with two contiguous curved portions 78*b*, 78*c*. The operation of the chip receptacle mechanism is as follows:

Platform 67 (see FIG. 2*c*) has a plurality of central openings 67*b*-1 through 67*e*-1 and a plurality of arcuate openings 67*b*-2 through 67*e*-2. The central openings cooperate with presence sensors (to be more fully described) to detect the presence of a chip. The arcuate-shaped openings cooperate with denomination sensors (to be more fully described) to detect chip color and hence chip denomination. Initially, the window 69 is opened, as shown in FIG. 5*a*. One or more chips are placed in the chip receptacle and more specifically within openings 68*a* through 68*d*. FIG. 5*a* shows a chip C being lowered into the chip receptacle. FIG. 5*b* shows two chips positioned within the chip receptacle. When the elevator platform 67 is in the position shown in FIGS. 5*a* and 5*b* the "READY TO PLAY" display 36 is illuminated.

The amount of the bet is presented in display 28 shown in FIG. 1.

The "+" and "–" buttons 38 and 40 are selectively operated to select the number of consecutive wins desired by the player.

A game is begun by pushing the dealer's game begin button 14 causing the buttons 38 and 40 to be isolated and disabled from operation until the number of consecutive wins selected is reached or in the event of an intervening losing game.

Operation of the dealer's game begin button energizes motor 47. With the chip receptacle in the open position, motor 47 rotates counterclockwise causing drive pin 77*a*, driven through shaft 47*a*, worm gear 48 and worm gear 50 and shaft 51, to rotate counterclockwise, as shown by arrow A in FIG. 2*a*. The counterclockwise rotation begins at about "one o'clock" in FIG. 2*a* which initially causes drive pin 77*a* to move along curved recess portion 78*c*. During this time the carrier 70 does not move. However, the cam 55 is rotated causing the chip elevator to be lowered to receive chips and to provide clearance for the carrier 70 and window 69. Further, rotation causes drive pin 77*a* to move in the leftward direction along the linear portion 78*a* of guide groove 78 causing the carrier frame 70 and hence the transparent window 69 to move in the direction shown by arrow B.

Figure 3A:
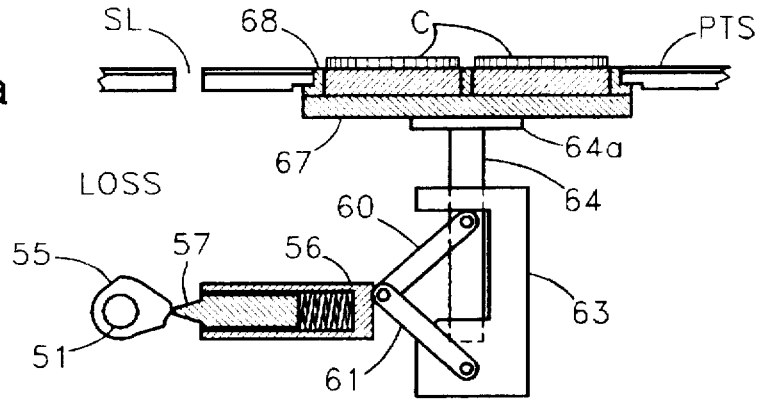
FIGS. 3*a*–3*d* show various stages of the chip "elevator" mechanism incorporated into the player's side bet unit of FIGS. 2*a*–2*d*.
Figure 3B:
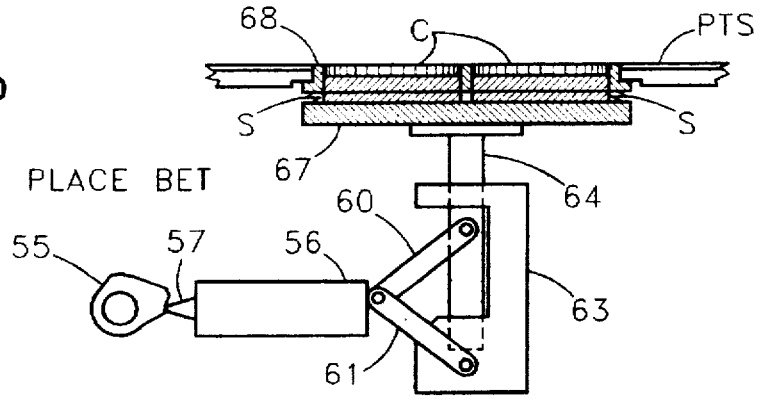

FIG. 3*b* shows the position of cam 55 at the moment in which chips are being received. It should be noted that the nose of cam follower 57 is positioned to engage a notch in the surface of cam 55 whereby push rod 56 moves to the left sufficiently to enable the knee of levers 60 and 61 to move to the left, thereby lowering the end of lever 60 and hence lowering the elevator shaft 64. The springs S between the engaging surfaces of chip elevator 67 and chip holder 68 assure the downward movement of chip elevator 67, dropping the chips C below the Playing Table Surface PTS.

Figure 3C:
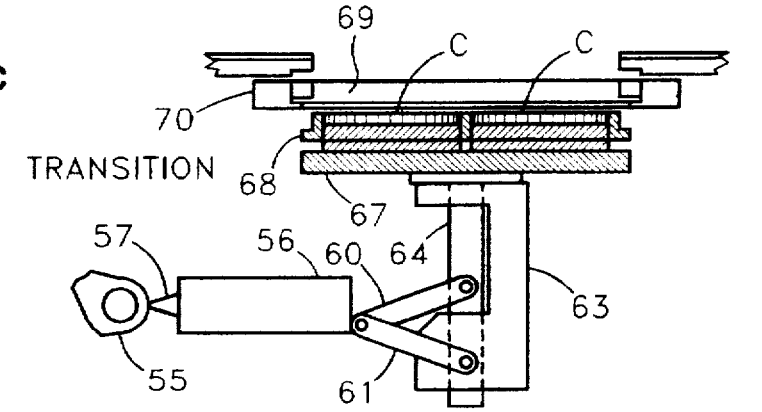

As the motor continues its rotation, cam 55 moves to the position shown in FIG. 3*c* whereby the nose of the cam follower 57 and push rod 56 move further to the left relative to FIG. 3*b*, causing elevator shaft 64 to move downwardly to the lower-most position shown in FIG. 3*c* whereby the chip elevator platform and chip holder 68, as well as the chips C, move downwardly. This position is also shown in FIG. 5*c*.

As was pointed out hereinabove, the drive pin 77*a* which is moving the transparent member frame 70, moves frames 70 so that it is immediately above the chip holder 68 and chip elevator 67. This position is shown in FIG. 5*d* as well as FIG. 3*c*.

As carrier frame 70 moves in the direction shown by arrow B, pin 77*a* moves towards the left-hand end of the linear section 78*a* of groove 78 and when the arm 77 reaches a "nine o'clock" position, pin 77*a* moves from the right to the left. When drive pin 77*a* is in the "six o'clock" position (relative to FIG. 2*a*), drive pin 77*a*, which continues to move counterclockwise, enters into the curved recess portion 78*b* and moves out of this recess. The carrier 70 is not moved during the time that drive pin 77*a* is in curved recess 78*c*.

Figure 3D:
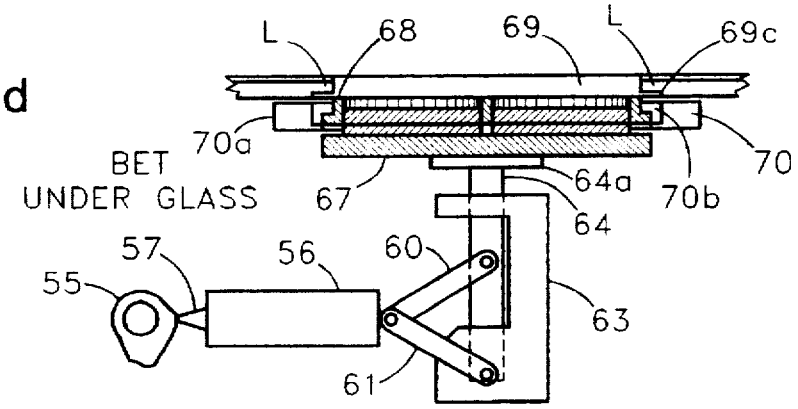

Substantially simultaneously therewith, i.e. during the time that the drive pin 77*a* is in the curved section 78*b*, the nose of cam follower 57 engages the portion of the cam 55 as shown in FIG. 3*d* which causes push rod 56 to be moved toward the right which causes elevator shaft 64, platform 64*a*, chip elevator 67 and chip holder 68 to be lifted upwardly to the position shown in FIG. 3*d*, lifting the glass cover plate 69 upwardly from its position resting upon the support flanges 70*a*, 70*b* and so that its upper notched region 69*c* engages the cooperating notches N in the Playing Table Surface PTS so that the central portion 69*c* of cover 69 projects through Glass Opening GO which receives the central portion 69*c*, thereby locking the glass cover into position preventing the glass cover from movement in a horizontal direction due to the fact that the marginal portions of the Glass Openings engages all four sides of the central portion 69*c* and further preventing any movement in the vertical direction due to the fact that elevator shaft 64 and supporting platform 64*a* maintains the chip elevator 67, chip holder 68 and glass member 69 in the covering position with cover 69 pressed against lip L of the portion of the table surrounding cover 69.

FIG. 5*d* shows the position occupied by the glass cover 69 preparatory to being locked into position. FIG. 5*e* shows the elevated position in which the top surface of the glass cover plate is flush with the Playing Table Surface PTS. In this position, although the chips cannot be disturbed, the chips can be viewed throughout the entire time required to play the number of consecutive wins selected by the player.

In the event that a player who has selected a given consecutive win experiences a losing hand, the dealer presses the Loss button 44 of that player's unit 20, causing the motor 47 to be energized and to be rotated in a reverse direction which cause drive rod 77 and drive pin 77*a* to move in the clockwise direction. Drive pin 77*a* enters into curved portion 78*c* of recess 78 and eventually moves into the linear portion 78*a* thereof. When the drive pin 77*a* is in curved section 78*c*, the carrier does not move. However, the cam 55 is rotating at this time. As the drive arm 77 moves in the clockwise direction from the "six o'clock" position to the "nine o'clock position" relative to FIG. 2*a*, drive pin 77*a* moves towards the left-hand end of groove 78. Prior to movement of the carrier frame 70, i.e. when drive pin 77*a* is in the curved recess 78*c* (from about the "five o'clock" position to the "six o'clock" position) cam 55 moves from the position shown in FIG. 3*d* through the position shown in FIG. 3*c*, dropping the chip elevator 67 and chip holder 68 downwardly, causing the glass panel 69 to be lowered from the locked position shown, for example, in FIG. 3*d* so that the glass plate 69 is now resting upon the support flange of carrier frame 70.

As drive pin 77*a* moves from the "six o'clock" position toward the "twelve o'clock" position of FIG. 2*a*, the carrier 70 and glass plate 69 are moved from the position immediately above the chip receptacle to the position fully displaced from the chip receptacle as shown in FIG. 2*a*, frame 70 occupying the solid line position shown therein.

The drive pin thereafter moves from the "twelve o'clock" position to approximately the "one o'clock" position moving along curved groove 78*c*, which movement is required to move cam 55 to the position shown in FIG. 3*a* causing the push rod 56 to be moved to the right, lifting chip elevator 67 and chip holder 68 to the position shown in FIG. 3*a* so that chips C are elevated above the Playing Table Surface PTS and can be easily swept away by the dealer.

FIG. 5*f* shows members 67, 68 and 69 being lowered, FIG. 5*g* shows the glass cover 69 moved to the right after members 67 and 68 have been lowered to provide clearance for movement of glass plate 69, while FIG. 5*h* shows the members 67 and 68 in the raised positioned in which chips C are arranged above the Playing Table Surface PTS to be easily and readily removed by the operator.

FIG. 6*a* shows further details of the chip detection and chip denomination sensors. A typical chip is shown in FIG. 6*a* as having a white colored central portion surrounded by a band of a given color or striped radial (i.e. "spoke-like") bands of different colors. Detection of the presence of a chip is obtained through the use of light emitting diode D1 and light sensitive diode D2.

Incident light from diode D1 is reflected from the bottom surface of a chip, when a chip is present, causing reflected light to be picked up by diode D2.

D1 is caused to turn on and off at 31.25 kHz. The output of D2 is coupled to a band-pass filter which only passes a signal having a frequency of 31.25 kHz, to distinguish the received signal from any and all ambient light sources such as lighting used in a gaming casino (light bulbs, fluorescent bulbs, etc.), a flashlight or any other light source.

A denomination of a detected chip is determined through the use of light emitting diodes D3, D4, and D5 and light sensitive diode D6. A digital output from the microprocessor controlling a side bet unit, such as 20, energizes the diodes D3 through D5 in a sequential fashion. The diodes may either emit yellow, green or red colored light or alternatively may be a light source emitting white light and having a transparent or white, green and red filter, respectively positioned between each of the white light generating diodes D3, D4 and D5 and the chip. Alternatively, other color combinations and colored light sensors may be employed without departing from the scope of the present invention, simply by using light emitting devices of different colors or different colored filters with white light sources.

The microprocessor or computer controls the sequence of closing of switches SWD, SWE and SWF for selectively coupling power across each of the diodes. The coupling sequence is shown in FIG. 6*b* by the waveform groups 81 through 84 which are respectively provided to describe the manner in which red, white, green and black chips, or a combination thereof, are detected.

Considering the waveform group 81, switch SWD is closed to generate constant width square pulses at $t_0$, $t_0$+T, $t_0$+2T and so forth as shown by waveform 81*a*, T being a constant. Similarly, switch SWE generates constant width square pulses at $t_1$, $t_1$+T, $t_1$+2T, etc. as shown by waveform 81*b*. In a similar fashion, switch SWD is closed causing light emitting diode D5 to generate constant width square pulses at time $t_2$, $t_2$+T, $t_2$+2T and so forth. When light of a red wavelength is detected by sensing diode D6, an output is generated at times $t_0$, $t_0$+T, $t_0$+T and so forth, as shown by waveform 81*d*.

Waveform groups 82 and 83 respectively detect the presence of a white band on the chip when light is detected at time $t_2$, $t_2$+T, $t_2$+2T and so forth. A green chip is detected when an output signal is provided at the amplifier AMPC at times $t_1$, $t_1$+T, $t_1$+2T and so forth.

When the chip having a black color band is present, detecting diode D6 fails to detect the presence of light in the red, green or white wavelength which is detected as the presence of a black chip. This information is utilized to determine the denomination of each chip. The sensors of each chip position are sequentially read and the denominations are totalled. The microprocessor multiplies the total amount bet by the odds based on the consecutive wins selected and displays the result as the payoff.

The output from the photodiode is connected through the amplifier to an analog to digital A/D converter within the computer so that the adjustments can be made within the software for compensating for color variations, etc. Assuming that a $100.00 chip having colored "spokes" is placed within one of the chip receiving recesses, the microprocessor will receive signals from all of the colors. By measuring the amplitudes of the signals and processing these signals in the software, an accurate determination of the chip can be made. False readings due to ambient conditions are eliminated by disabling the value detection system until the chip detection system has determined that the chip is properly placed in a chip recess.

It should be understood that switches SWC, SWD, SWE and SWF are common to all light sources for all four chip receiving depressions. The modulator which generates the red, white and green pulses is likewise common to all four of the sets of light sources associated with each chip recess of the chip detection system.

The push key 42 shown in FIG. 1 is optional and may be provided in those applications wherein a tie occurs, i.e. when a player and a dealer have hands totalling the same amount, which amount is no greater than twenty-one (21)).

In applications where a "Push" is considered to be a win, the push key 42 may be eliminated or ignored.

As an alterative to the chip receptacle, chips may be placed in a chip slot and fall by gravity into a protected container arranged beneath the table. As each chip is placed in the slot, it is examined for presence and denomination.

Alternatively, chips returned by the chip receptacle may be swept into a hopper or container (not shown) arranged beneath the table and communicating with the Playing Table Surface PTS by a slot SL. The chips are swept from the chip receptacle and into the slot SL provided and fall into the hopper when a player loses his side bet or when a payoff is to occur at a remote location.

Although the embodiment described hereinabove incorporates the consecutive wins side bet units into a blackjack game, it should be understood that the side bet system and the units thereof may be employed in all other games of chance played at tables such as roulette, craps, poker, mini-baccarat, etc. The consecutive win side bet system may be very easily integrated into poker games played at a table regardless of whether the game is five card stud or low hand poker challenge (as well as other poker games) as will be described hereinbelow in greater detail. The consecutive wins payoff and bet options listed below represent the payoff for all table games, slot machines or video games.

When integrated into a craps game consecutive wins may be limited to the number of consecutive times a player wins. Other bets such as the number of consecutive times a player throws a particular number can be employed as another possible side bet.

When integrated into a roulette game, consecutive wins may be limited to the number of consecutive times the player correctly selects an odd bet or an even bet, a black bet or a red bet. Copending application Ser. No. 08/396,051 describes additional bet switches to be used to indicate to the system whether an odd, even, red or black bet is selected by the player as shown in FIG. 3 thereof which depicts a roulette layout. The touch screen is replaced in the bet unit 20 shown in FIG. 1 of the present application.

The side bet system may be utilized in a slot machine or a video game wherein the unit may either be integrated into the machine housing or positioned immediately adjacent thereto and the electrically connected with the game operating circuitry.

For example, in a video blackjack slot machine which simulates a dealer and player playing head to head, one or more chips may be arranged within the chip receptacle or coins or tokens may be deposited directly into the machine either in the same receptacle receiving a coin or token for initiating play of a game or in a separate coin or token slot and then a number of consecutive wins is selected by the operator. As each play is completed, a signal indicating a winning play increments the consecutive wins display 30 (see FIG. 1). When the number of consecutive wins in display 30 equals the number of consecutive wins selected and presented by display 32, all of the lights on the display panel flash, preferably accompanied by an audible alarm to indicate a payoff. The payoff may be derived either from the video slot machine or a central payoff window. Suitable video games with which the bet unit 20 may be interfaced may, for example, be Live Video Poker, Live Video Roulette and Live Video Craps produced by ICGA and Aces and Faces produced by IGT. However, any other video game may be utilized, if desired.

Figure 7:
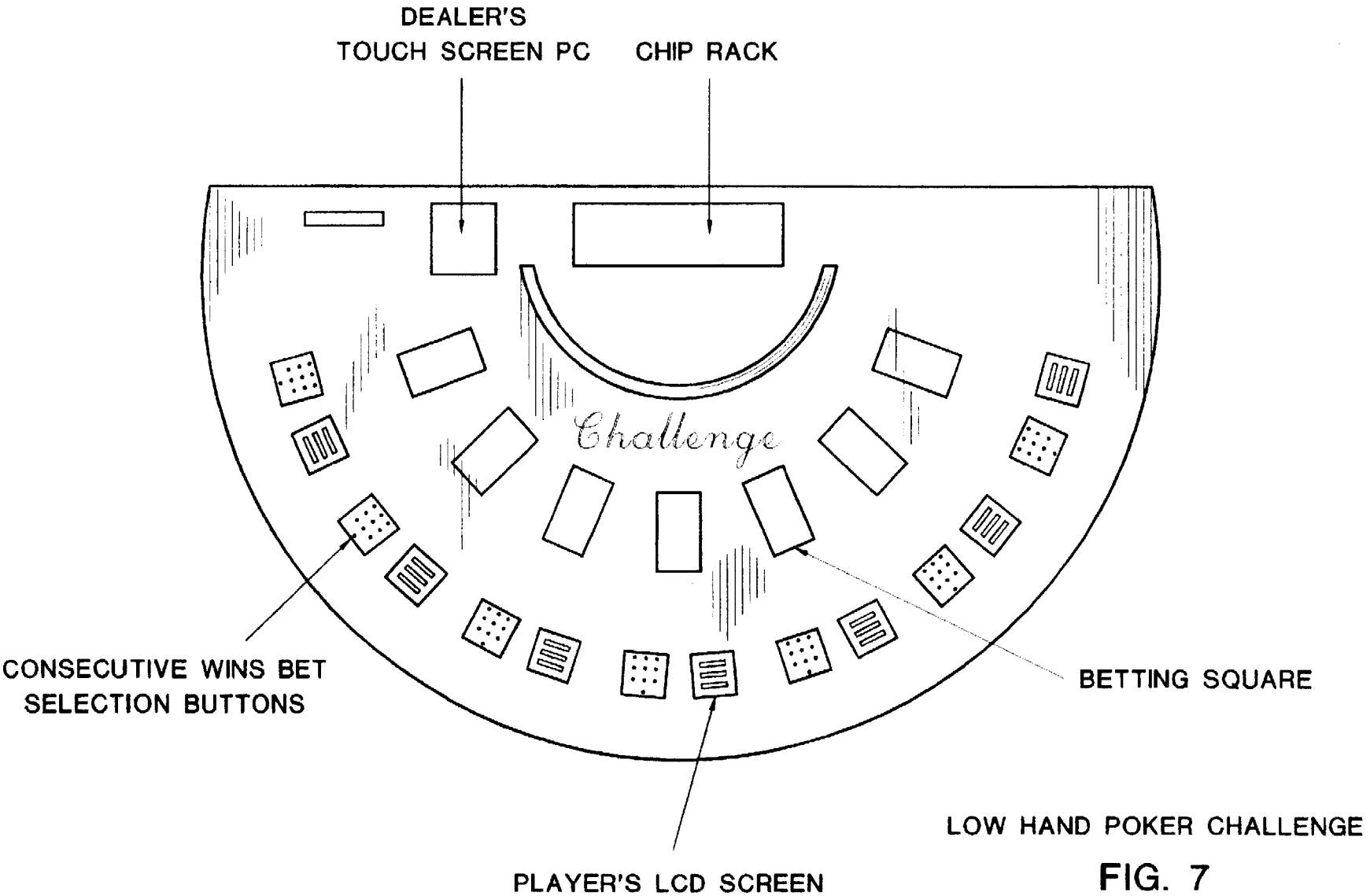
FIGS. 7–10 shows views of other games embodying the side bet system of the present invention.

FIG. 7 shows a low hand poker challenge table game in which the side bet system of the present invention is integrated. The low hand poker challenge operates as follows:

Player Procedures:

Player selects one of thirteen consecutive bet options listed under Payoff Rules as previously described under blackjack. All other procedures before the game begins are the same as blackjack. Whether the game is a table game, a video game, or a slot machine, the casino determines the number of bet options which may be selected.

Dealer gives each player and himself one card at a time, dealing left to right until all five cards are dealt. The cards are dealt face down. The Dealer exposes his cards one at a time after the Players have seen their cards. The lowest hand of the dealer or player wins as described hereinbelow.

A bet unit 20 (see FIG. 1) is provided adjacent to each player as in blackjack; however, there will not be a conventional bet as in blackjack—only the consecutive wins bet.

| | |
|---|---|
| 2 consecutive wins pays | 4 for 1 |
| 3 consecutive wins pays | 7 for 1 |
| 4 consecutive wins pays | 15 for 1 |
| 5 consecutive wins pays | 30 for 1 |
| 6 consecutive wins pays | 60 for 1 |
| 7 consecutive wins pays | 120 for 1 |
| 8 consecutive wins pays | 240 for 1 |
| 9 consecutive wins pays | 480 for 1 |
| 10 consecutive wins pays | 960 for 1 |
| 11 consecutive wins pays | 1920 for 1 |
| 12 consecutive wins pays | 3840 for 1 |
| 13 consecutive wins pays | 7680 for 1 |
| 14 consecutive wins pays | 15,360 for 1 |

Rules:

The lowest possible hand is a 7, 5, 4, 3, 2 of mixed suits; and

Poker hands in order of lowest to highest: no pair, one pair, two pair, three of a kind, straight flush, full house, four of a kind, and straight.

No Pair: The smallest denomination card wins. If player—dealer have the same highest card, or, same two highest cards, or same three highest cards, or same four highest cards, the next card determines the winner. If all five cards are the same, there is no winner and the game is delayed.

One Pair: If player—dealer have One Pair (two cards of the same numerical value), the lowest value pair wins. If both player—dealer have a pair of the same value, the lowest third, fourth (if necessary), or fifth (if necessary) lowest card determines the winner.

Two Pair: If player—dealer hands consist of Two Pairs, the lower of the two pairs wins. If player—dealer lowest pair is the same, the second lowest pair determines the winner. If player—dealer have the same two pairs, the lowest odd card determines the winner.

Three of a Kind: If player—dealer have Three of a Kind, the lowest numerical value three cards of the same denomination wins.

Straight: the lowest of five cards that run in numerical order with a mixture of suits wins, if player—dealer both have a Straight.

Flush: if all five cards are the same suit, the player or dealer has a Flush. If both have flushes, the smallest denomination cards win as in No Pair.

Full House: a combination of Three of a Kind a A Pair is a Full House. The lowest numerical value Three of a Kind wins, if both player and dealer have Full House.

Four of a Kind: the lowest numerical value four cards of the same denomination wins, if both player and dealer have Four of a Kind.

Straight Flush: the lowest value cards that run in numerical order and are the same suit wins, if both player and dealer have a Straight Flush.

Figure 8:
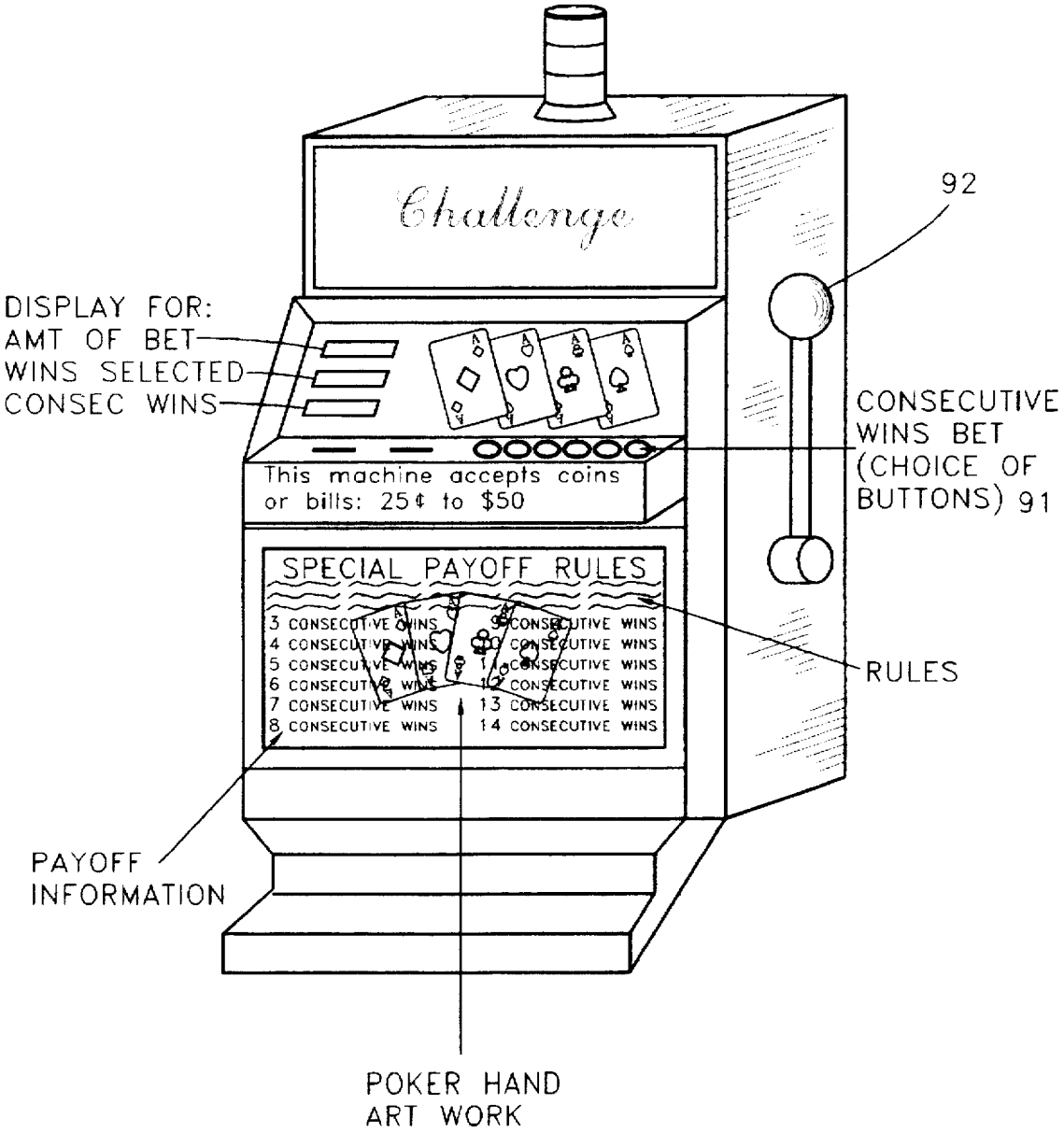

FIG. 8 shows a low-hand poker slot challenge game. The operation of the game and machine is as follows:

Player Procedures:

Insert bills, coins or tokens into slot 92 of machine 90, representing amount of bet.

Select one of thirteen consecutive bet options (listed under payoff) by operating button (or buttons) 91.

Selection cannot be changed once made as was described hereinabove.

After handle 92 is pulled, or a button pushed, if casino so desires, dealer's five cards and player's five cards are shown on machine screen, one at a time. Player's first card appears, followed by the dealer's first card, which is followed by player's second card, etc.

The rules as described hereinabove for low hand poker apply here.

Displays:

LCD Screen located on front of machine will show payoff (28):

Dollar amount of bet once placed (28);

Consecutive win selection (32); and

Number of consecutive wins (30), consecutive win number reverts to zero if player loses.

Figure 9:
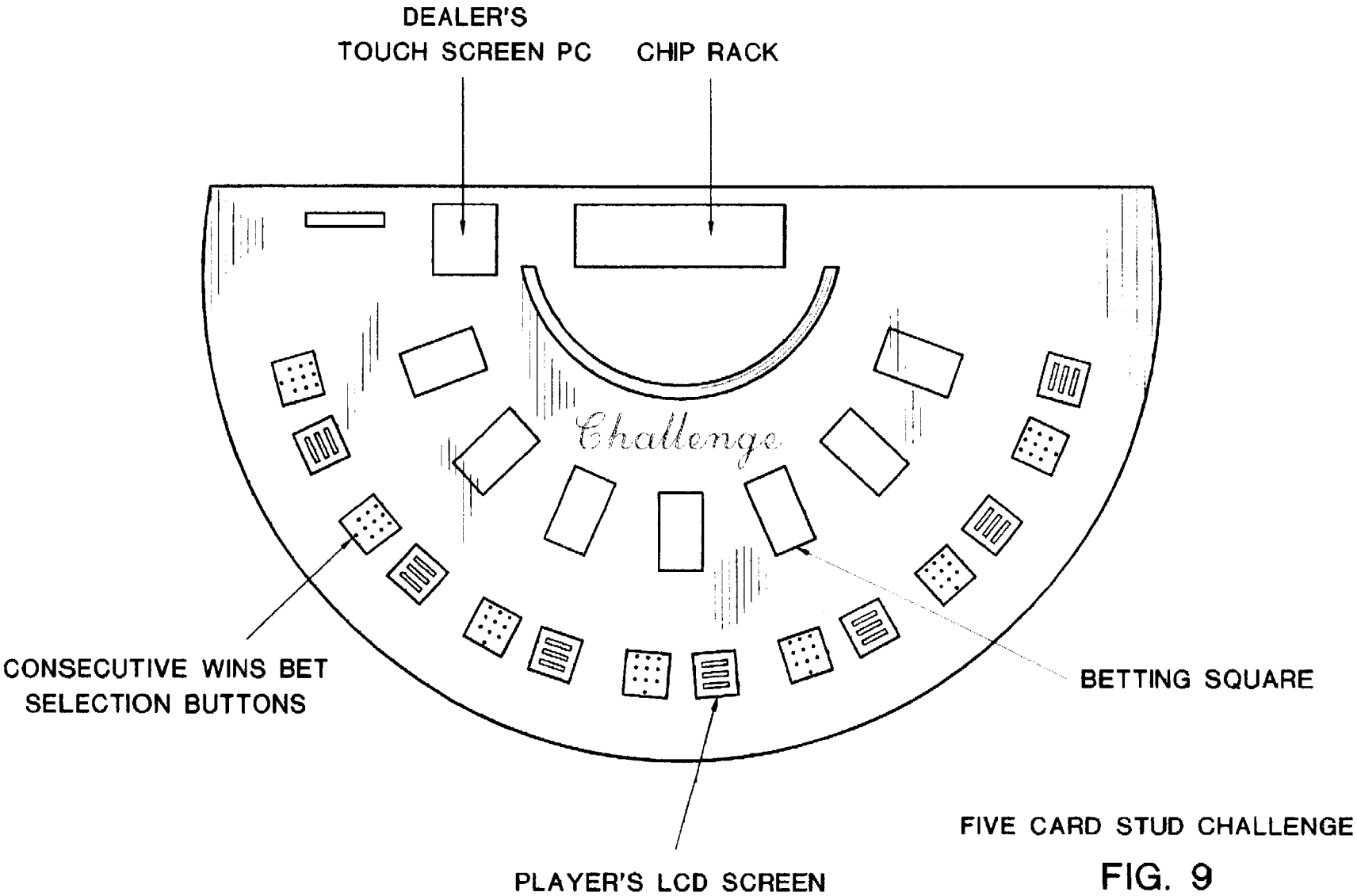

FIG. 9 shows the manner in which the side bet system and units of the present invention are integrated into a five card stud challenge game.

Player Procedures:

Chips ($1, $5, $25, $100) placed into the chip receptacle 20 (see FIG. 1) by player up to a maximum to be determined by casino.

Player selects one of thirteen consecutive bet options listed under Payoff Rules by pressing relevant buttons 38 or 40 (see FIG. 1).

Once placed, bets cannot be changed.

Dealer Procedures:

Dealer operates start game button 14 (see FIG. 1). Each players'consecutive wins display 30 is incremented under player loses whereupon Loss button 44 is pressed.

Dealer will give each player and himself one card at a time, dealing left to right until all five cards are dealt. The cards are dealt face down. The dealer will expose his cards one at time after the players have seen their cards.

Displays:

LCD Screens show:

dollar amount of bet once placed (28);

consecutive number of wins (30); and selected number of consecutive wins (32).

When player loses, light in consecutive bet selection button and LCD screen turns off and chips are uncovered and removed.

Payoff Rules:

| | |
|---|---|
| 2 consecutive wins pays | 4 for 1 |
| 3 consecutive wins pays | 7 for 1 |
| 4 consecutive wins pays | 15 for 1 |
| 5 consecutive wins pays | 30 for 1 |
| 6 consecutive wins pays | 60 for 1 |
| 7 consecutive wins pays | 120 for 1 |
| 8 consecutive wins pays | 240 for 1 |
| 9 consecutive wins pays | 480 for 1 |
| 10 consecutive wins pays | 960 for 1 |
| 11 consecutive wins pays | 1920 for 1 |
| 12 consecutive wins pays | 2840 for 1 |
| 13 consecutive wins pays | 7680 for 1 |
| 14 consecutive wins pays | 15,360 for 1 |

Rules:

The highest possible hand is the combination of Ace, King, Queen, Jack, and Ten of the same suit.

Poker hands in order of highest to lowest: Straight Flush, Four of a Kind, Full House, Flush, Straight, Three of a Kind, Two Pair, One Pair and No Pair.

Straight Flush: the highest value five cards that run in numerical order and are of the same suit wins, if both player and dealer have a Straight Flush.

Four of a Kind: the highest numerical value four cards of the same denomination wins, if both player and dealer have Four of a Kind.

Full House: a combination of Three of a Kind, and A Pair is a Full House. The highest numerical value Three of a Kind wins, if both Player and Dealer have a Full House.

Flush: If all five cards are of the same suit, the Player or Dealer has a Flush. If both Flushes, the highest denomination cards win as described below under No Pair.

Straight: the highest five cards that run in numerical order with a mixture of suits wins, if player and dealer both have a Straight.

Three of a Kind: if player and dealer both have Three of a Kind, the highest numerical value three cards of the same denomination wins.

Two Pair: if player and dealer hands consist of Two Pairs (cards of the same numerical value), the highest value pair wins. If both player and dealer highest pair is the same, the second highest pair determines the winner. If player and dealer have the same two pairs, the highest fifth card determines the winner.

One Pair: If both player and dealer have One Pair, the highest pair wins. If both player and dealer have a pair of the same value, the highest third, fourth (if necessary) or fifth (if necessary) highest card determined the winner.

No Pair: the highest denomination card wins. If player and dealer have the same highest card, or same two highest cards, or same three highest cards, or same four highest cards, the next highest card determines the winner. If all five cards are the same, there is no winner and the game is replayed.

Figure 10:
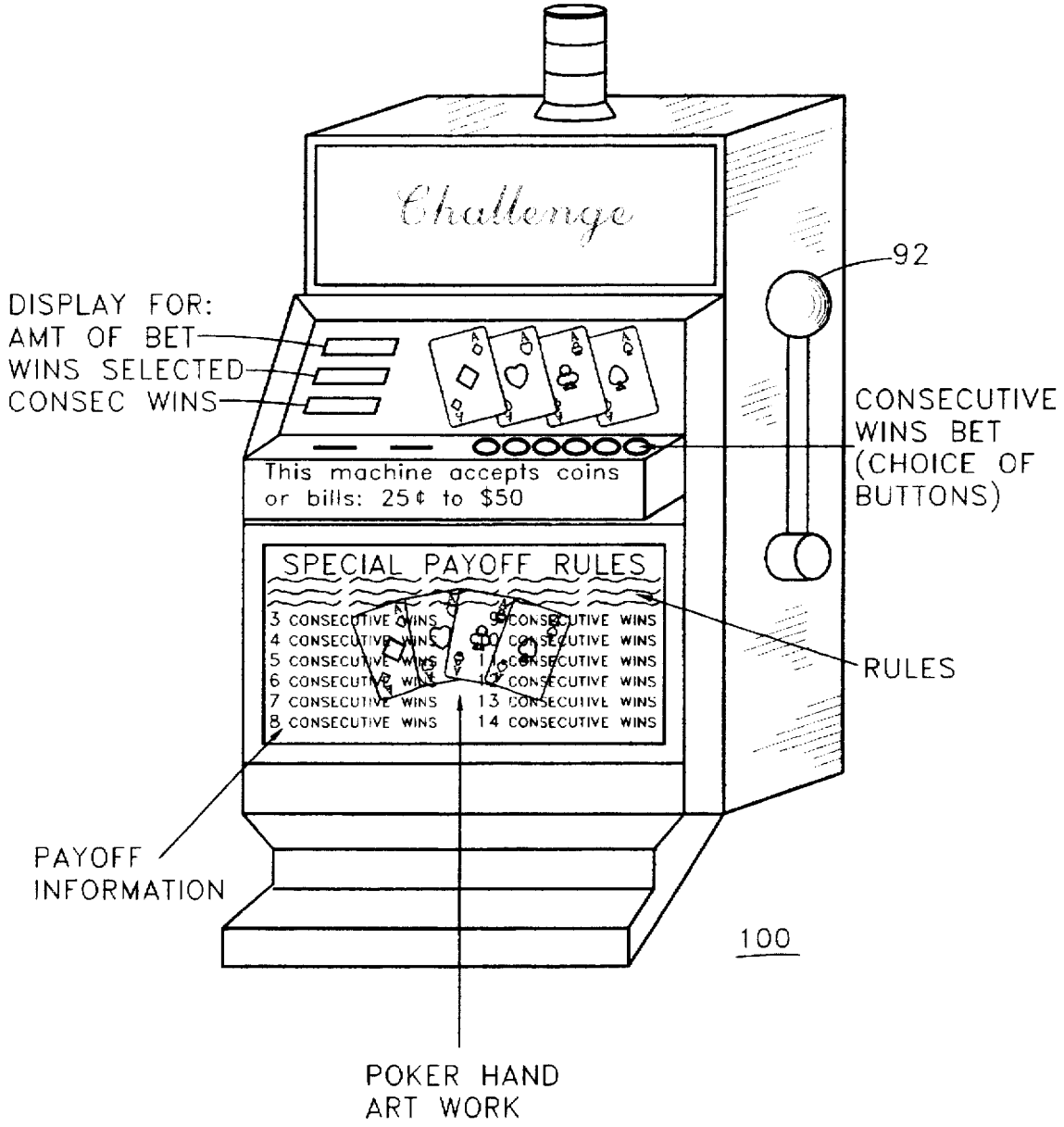

FIG. 10 shows a five card stud slot challenge game. The operation of the game and machine is as follows:

Player Procedures

Insert bills, coins or tokens representing amount of bet.

Select one of thirteen consecutive bet options (listed under payoff) by operating the buttons 38, 40 (see FIG. 1).

Selection cannot be changed once made.

After handle 101 is pulled (or button pressed), dealer's five cards and player's five cards will show on machine screen 102, one at a time. Player's first card is followed by dealer's first card, etc.

The rules described hereinabove in the five card stud table game apply here.

The payoff rules are the same as previously described for the various poker games and all other table games and video games.

Special Displays

Payoff (26);

Amount of bet (28);

consecutive win selection (30); and number of consecutive wins (38).

Consecutive win number reverts to zero if player loses. Player selects amount of bet, bet option and insert bills/coins in order to begin new bet cycle.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method of incorporating a consecutive win side bet into a game of chance comprising the steps of:

a) at least one player wagering at least one chip or coin to participate in the game of chance;

b) at least one player who, having wagered a chip or coin to participate in the game of chance, wagering a second chip or coin for a consecutive wins side bet;

c) said player making the wager of step (b) further making the side bet and selecting a number of consecutive wins from within a permitted range of numbers before a play begins;

d) presenting a display of a payoff amount according to the number of consecutive wins selected in step (c) and the amount of the wager made in step (b), and based on pre-programmed payoff odds which correspond to different values of the prospective consecutive wins; and e) providing a winning indication only when the player making the side bet wager wins a consecutive number of games played which is equal to the number of consecutive wins originally selected at step (c).

2. The method of claim 1 wherein the game of chance is blackjack and further including the steps of:

f) providing an indication of initiation of a game when at least one player has performed step (a);

g) covering the chip or coin wagered during step (a) responsive to the indication provided at step (f);

h) dealing each player who has performed at least step (a) and the dealer with a given number of cards;

i) paying off winning players and removing all wagers made at step (a) for all losing players; and j) providing a Loss button at each player's position; and k) operating a Loss button at a player's position of a player who has performed step (a) and has lost a game; and l) removing the display of the player whose Loss button was operated at step (k) and removing the wager made by said player during step (a).

3. The method of claim 1 wherein the game of chance is craps and further including the steps of:

f) a player who has performed at least step (a) throwing a pair of dice;

g) paying off winning players and removing all wagers made at step (a) for all losing players; and h) providing a Loss button at each player's position;

i) operating a Loss button at a player's position of a player who has performed step (a) and has lost a game; and j) removing the display of the player whose Loss button was operated at step (i) and removing the wager made by said player during step (b).

4. The method of claim 1 wherein the game of chance is baccarat and further including the steps of:

f) providing an indication of initiation of a game when at least one player has performed step (a);

g) covering the chip or coin wagered during step (b) responsive to the indication provided at step (f);

h) dealing each player who has performed at least step (a) and the dealer with a given number of cards;

i) paying off winning players and removing all wagers made at step (a) for all losing players; and j) providing a Loss button at each player's position; and k) operating a Loss button at a player's position of a player who has performed step (b) and has lost a game; and l) removing the display of the player whose Loss button was operated at step (k) and removing the wager made by said player during step (b).

5. The method of claim 4 further comprising the steps of:

m) accumulating a count of consecutive wins each time a player has won a previous hand responsive to the dealer providing an indication of initiation of a subsequent hand; and performing step (e) by utilizing the accumulated count obtained in step (m).

6. The method of claim 1 wherein the game of chance is roulette and further including the steps of:

f) providing an indication of initiation of a game when at least one player has performed step (a);

g) covering the chip or coin wagered during step (b) responsive to the indication provided at step (f);

h) operating a roulette wheel;

i) paying off winning players and removing all wagers made at step (a) for all losing players;

j) providing a Loss button at each player's position;

k) operating a Loss button at a player's position of a player who has performed step (b) and (b) and has lost a game; and l) removing the display of the player whose Loss button was operated at step (k) and removing the wager made by said player during step (b).

7. A method of playing a game of chance comprising the steps of:

a) at least one player wagering a chip or coin for a consecutive wins side bet;

b) said player making the wager of step (a) further making the side bet and selecting a number of consecutive wins from within a permitted range of numbers before a play begins;

c) presenting a display of a payoff amount according to the number of consecutive wins selected in step (b) and the amount of the wager made in step (a); and d) providing a winning indication only when the player making the wager of step (a) wins a consecutive number of games played which is equal to the number of consecutive wins originally selected during step (b).

8. The method of claim 7 wherein step (c) further comprises determining the payoff based upon pre-programmed payoff odds which correspond to different numbers of consecutive wins.

9. The method of claim 7 further comprising terminating the payoff display and removing the wager made in step (a) in the event that the player making such wager loses a game prior to achieving the selected number of consecutive wins.

10. The method of claim 7 wherein step (b) further comprises:

e) covering the consecutive wins bet made during step (a) within a receptacle during a consecutive win play period.

11. The method of claim 10 further comprising:

f) uncovering the bet covered during step (e) when either a player has achieved a number of consecutive wins equal to the selected number or when a player loses a game prior to achieving the selected number of consecutive wins.

12. The method of claim 11 further comprising flashing said display generated during step (c) when a player having made the bet of step (a) has won a number of consecutive games equal to the selected wins number.

13. The method of claim 12 wherein step of flashing the display further includes making an audible alarm contemporaneously with flashing of said display.

14. The apparatus of claim 12 wherein means is provided for identifying a game bet and an amount received by a chip receptacle is a side bet made in addition to a game bet.

15. The method of claim 7 wherein the game of chance is blackjack and further including the steps of:

d) providing an indication of initiation of a game when at least one player has performed step (a);

e) covering the chip or coin wagered during step (a) responsive to the indication provided at step (d);

f) dealing each player who has performed at least step (a) and the dealer with a given number of cards;

g) paying off winning players and removing all wagers made at step (a) for all losing players; and h) providing a Loss button at each player's position; and i) operating a Loss button at a player's position of a player who has performed step (a) and has lost a game; and j) removing the display of the player whose Loss button was operated at step (i) and removing the wager made by said player during step (a).

16. The method of claim 15 further comprising the steps of:

k) accumulating a count of consecutive wins each time a player has won a previous hand responsive to the dealer providing an indication of initiation of a subsequent hand; and performing step (d) by utilizing the accumulated count obtained in step (l).

17. The method of claim 1 wherein the game of chance is poker and further including the steps of:

f) providing an indication of initiation of a game when at least one player has performed steps (a) and (b);

g) covering the chip or coin wagered during step (b) responsive to the indication provided at step (f);

h) dealing each player who has performed at least step (a) and the dealer with a given number of cards;

i) paying off winning players and removing all wagers made at step (a) for all losing players; and j) providing a Loss button at each player's position; and k) operating a Loss button at a player's position of a player who has performed step (b) and has lost a game; and l) removing the display of the player whose Loss button was operated at step (k) and removing the wager made by said player during step (b).

18. The method of claim 17 further comprising the steps of:

m) accumulating a count of consecutive wins each time a player has won a previous hand responsive to the dealer providing an indication of initiation of a subsequent hand; and performing step (e) by utilizing the accumulated count obtained in step (m).

19. The method of claim 7 wherein the game of chance is blackjack and further including the steps of:

e) providing an indication of initiation of a game when at least one player has performed step (a);

f) covering the chip or coin wagered during step (a) responsive to the indication provided at step (e);

g) dealing each player who has performed at least step (a) and the dealer with a given number of cards;

h) paying off winning players and removing all wagers made at step (a) for all losing players; and i) providing a Push button at each player's position; and j) operating a Push button at a player's position of a player who has performed step (a) and has tied a game; and k) removing the display of the player whose Loss button was operated at step (j) and removing the wager made by said player during step (a).

20. The method of claim 7 wherein the game of chance is poker and further including the steps of:

e) providing an indication of initiation of a game when at least one player has performed steps (a) and (b);

f) covering the chip or coin wagered during step (a) responsive to the indication provided at step (e);

g) dealing each player who has performed at least step (a) and the dealer with a given number of cards;

h) paying off winning players and removing all wagers made at step (a) for all losing players; and i) providing a Loss button at each player's position; and j) operating a Loss button at a player's position of a player who has performed step (a) and has lost a game; and k) removing the display of the player whose Loss button was operated at step (j) and removing the wager made by said player during step (b).

21. The method of claim 20 further comprising the steps of:

1) accumulating a count of consecutive wins each time a player has won a previous hand responsive to the dealer providing an indication of initiation of a subsequent hand; and performing step (d) by utilizing the accumulated count obtained in step (1).

22. The method of claim 7 wherein the game of chance is craps and further including the steps of:

e) a player who has performed at least step (a) throwing a pair of dice;

f) paying off winning players and removing all wagers made at step (a) for all losing players; and g) providing a Loss button at each player's position; and h) operating a Loss button at a player's position of a player who has performed step (a) and has lost a game; and i) removing the display of the player whose Loss button was operated at step (h) and removing the wager made by said player during step (b).

23. The method of claim 7 wherein the game of chance is baccarat and further including the steps of:

e) providing an indication of initiation of a game when at least one player has performed step (a);

f) covering the chip or coin wagered during step (a) responsive to the indication provided at step (e);

g) dealing each player who has performed at least step (a) and the dealer with a given number of cards;

h) paying off winning players and removing all wagers made at step (a) for all losing players; and i) providing a Loss button at each player's position; and j) operating a Loss button at a player's position of a player who has performed step (a) and has lost a game; and k) removing the display of the player whose Loss button was operated at step (j) and removing the wager made by said player during step (a).

24. The method of claim 23 further comprising the steps of:

1) accumulating a count of consecutive wins each time a player has won a previous hand responsive to the dealer providing an indication of initiation of a subsequent hand; and performing step (d) by utilizing the accumulated count obtained in step (1).

25. The method of claim 7 wherein the game of chance is roulette and further including the steps of:

e) providing an indication of initiation of a game when at least one player has performed step (a);

f) covering the chip or coin wagered during step (a) responsive to the indication provided at step (e);

g) operating a roulette wheel;

h) paying off winning players and removing all wagers made at step (a) for all losing players;

i) providing a Loss button at each player's position;

j) operating a Loss button at a player's position of a player who has performed step (a) and has lost a game; and k) removing the display of the player whose Loss button was operated at step (j) and removing the wager made by said player during step (a).

26. The method of claim 25 further comprising the steps of:

1) accumulating a count of consecutive wins each time a player has won a previous game responsive to providing an indication of initiation of a subsequent game; and performing step (e) by utilizing the accumulated count obtained in step (1).

27. The method of claim 25 further comprising the steps of:

1) accumulating a count of consecutive wins each time a player has won a previous game responsive to providing an indication of initiation of a subsequent game; and performing step (d) by utilizing the accumulated count obtained in step (1).

28. Betting apparatus, comprising:

a chip receptacle;

means for detecting a presence and a denomination of a chip placed in said chip receptacle;

display means and means for operating said display means to select a given number of consecutive wins from a permissible range ofnumbers;

controller means responsive to said means for operating and a denomination of a chip in said chip receptacle for generating a payoff amount;

display means for displaying a number of consecutive games won and a payoff amount; and means responsive to initiation of a game of chance associated with the betting apparatus for preventing the number of consecutive wins, the amount of the bet and payoff from being changed until either a game is lost before the selected number of consecutive wins is attained or the number of games won equals the number of consecutive wins selected.

29. The betting apparatus of claim 28 further comprising:

said controller means including means for advancing the number of games won and displaying said number responsive to operation of a dealer-operation button.

30. The betting apparatus of claim 29 further comprising:

said controller means including means for indicating a consecutive games bet win when a number of games won in said display equals the number displayed in said selected consecutive wins display.

31. The betting apparatus of claim 28 further comprising a Loss button and means which, when the Loss button is operated, removes data on display to indicate that a player has lost a game prior to achieving the consecutive number of wins presented in the consecutive wins selected display.

32. The apparatus of claim 28 further comprising a Push button and means responsive to operation of the Push button for incrementing a number of wins displayed to indicate that values of hand held by a player and dealer are equal.

33. The apparatus of claim 32 further comprising means for uncovering said chip receptacle when the Loss button is operated.

34. The apparatus of claim 32 wherein said cover means includes a transparent member, which, while covering the chip receptacle, permits visual observation of the contents thereof.

35. The apparatus of claim 28 further comprising means for covering said chip receptacle responsive to initiation of said game of chance, and further comprising means to prevent said chip receptacle from being uncovered until a consecutive number of games won equals the number presented in the selected consecutive wins display.

36. The apparatus of claim 35 for removing all of the displays when the Loss button is operated.

37. The apparatus of claim 28 further comprising a dealer-operated button adjacent to a dealer presiding over the game of chance and operable to provide an indication of initiation of said game of chance, said means for preventing being operated responsive to said dealer-operated button.

38. The combination of claim 28 further comprising means for storing data inputted into said bet unit during use thereof.

39. The combination of claim 38 further comprising means for displaying the stored data responsive to operation of a display data switch.

40. The combination of claim 38 wherein the data stored includes the total number of games, total amount of bet, and total amount paid out; for each game, the consecutive wins selected, the amount of a bet of each game, the payoff of each win and number of games played before loss; and an identification number of the unit.

41. The combination of claim 38 further comprising means for transferring the stored data to a portable unit responsive to connection of said portable unit thereto.

42. A betting unit comprising:

a chip receptacle;

a transparent cover moveable between a first position above said chip receptacle and second position displaced from said chip receptacle;

a housing for said chip receptacle having an opening above said chip receptacle and a surrounding marginal lip extending inwardly from said opening;

elevator means for movably supporting said chip receptacle between an upper and a lower position respectively closer to and further away from said housing opening;

drive means;

first means responsive to operation of said drive means for moving said cover between said first and second positions;

second means responsive to operation of said drive means for moving said elevator means between said upper and said lower positions, said firat and second means being so interrelated as to lower said chip receptacle when said cover is being moved to said first position, raise said elevator when said cover reaches said first position, to press a marginal notch in said cover into engagement with the marginal lip of the housing and lower the elevator to provide clearance for said cover when being mover from said first position to said second position.

43. The apparatus of claim 42 further comprising a carrier for supporting said cover and being moveable between said first and second positions;

said carrier having a supporting flange engaging and supporting a marginal peripheral portion of said cover when said elevator means is lowered and for enabling the cover to be lifted from said carrier supporting flange toward said housing opening when said elevator means raises said chip receptacle.

44. A chip receptacle for use in a betting apparatus for providing a bet in a game of chance, comprising:

a housing having an opening;

a chip receptacle mounted in said housing and beneath said opening;

elevator means for raising and lowering said chip receptacle;

a carrier frame moveable between a first position between said chip receptacle and said opening and a second position displaced therefrom, the path of movement of said carrier being substantially perpendicular to the path of movement of said elevator means;

a transparent cover supported by and moveable with said carrier;

a drive source;

first means responsive to said drive source for moving said carrier between said first and second positions; and second means moveable by said drive source for raising and lowering said elevator means, whereby said elevator means is lowered when said carrier moves from said second position towards said first position and is thereafter raised to lift said cover from said carrier and urge a central portion of said carrier into said opening when said carrier has reached said second position.

45. The chip receptacle of claim 44 wherein said drive source is a motor provided with an output shaft;

a driven shaft;

first coupling means between said motor output shaft and said driven shaft for rotating said driven shaft;

said first coupling means comprising a drive arm mounted to rotate with said driven shaft and having one end secured to said driven shaft;

a drive pin at an opposite end of said drive arm; and groove means in said carrier slidably receiving said drive arm whereby rotational movement of said drive arm is converted into transnational movement of said carrier between said first and second positions.

46. The apparatus of claim 45 wherein said means for coupling drive from said motor output shaft to said driven shaft comprises a first worm gear mounted on said motor output shaft and a second worm gear mounted on said driven shaft and meshing with said first worm gear.

47. The apparatus of claim 44 wherein said drive means is a motor having an output shaft;

a driven shaft and means for coupling drive from said motor output shaft to said driven shaft;

said second coupling means comprising a cam mounted on said driven shaft;

a cam follower engaging said cam means and means coupled between said cam follower and said elevator means for selectively lifting and lowering said elevator means responsive to rotation of said cam means.

48. The apparatus of claim 47 wherein said elevator means comprises a shaft and means for slidably supporting said shaft to permit such shaft to experience movement along its longitudinal axis;

said chip receptacle being supported by an upper end of said shaft, said coupling means be coupled between said shaft and said cam follower.

49. The apparatus of claim 44 wherein said second coupling means is comprised of first and second linkage arms;

a first end of said first linkage arm being swingably coupled to a first end of said second linkage arm;

a second end of said first linkage arm being swingably coupled to said support slidably supporting said shaft;

a second end of said second linkage arm being pivotally coupled to said shaft;

said first end of said first linkage arm and said first end of said second linkage arm pivotally coupled thereto forming a knee slidably engaging said cam follower whereby movement of said knee by said cam follower selectively raises and lowers said shaft supporting said chip receptacle.

50. The apparatus of claim 49 wherein said chip receptacle comprises a platform;

a member having a plurality of openings each adapted to receive a chip;

said platform having disc-shaped projections moveable into said chip openings in said member;

spring means arranged between said chip holder and said chip elevator;

said elevator means including means for moving said disc-shaped projections into said chip receiving openings in said chip holder when said cover is removed to facilitate removal of chips arranged therein and for moving said chip elevator downwardly by an amount sufficient to place chips in said chip holders so that an upper surface of said chips is at least substantially flush with an upper surface of said chip holder, and said chip holder being pressed against said cover in the closed position.

51. The chip receptacle of claim 50 further comprising pairs of openings for each chip which may be received by the chip receptacle;

each pair of openings being positioned beneath a chip holding opening in said chip holder;

a first detection sensor for detecting a presence of a chip arranged beneath one of said openings and a second denomination sensor for detecting a denomination of a chip arranged beneath a second one of said openings.

52. The apparatus of claim 51 wherein said first sensor comprises a light emitting device and a light sensitive device for detecting the presence of light emitted from said light emitting device and reflected by a bottom surface of a chip.

53. The apparatus of claim 51 wherein said denomination detecting sensor comprises a plurality of light emitting elements for respectively emitting lights of different wavelengths and a light sensing element;

means for selectively energizing said light emitting elements at different time intervals; and means responsive to light reflected from a bottom surface of a chip and detected by said light sensing element and to a time at which said reflected light is sensed for identifying a wavelength of sensed light and means responsive to a light wavelength detected for determining a denomination of a chip.

54. In combination, a gaming machine and a betting unit, comprising:

said machine having an operating member and means for receiving a wager and means responsive to said means for receiving said wager and operation of said operating member for initiating a game;

said betting unit including means for receiving a wager;

means for manually inputting a selected number of consecutive wins;

means for displaying a selected number of consecutive wins responsive to said manual means;

means for accumulating a number of consecutive wins each time a player wins a game; and means for providing a payoff signal when the number of consecutive games won equals the selected number of consecutive wins.

55. The combination of claim 54 further comprising means for displaying a payoff amount based on an amount wagered and a member of consecutive wins selected.

56. The combination of claim 54 wherein said side bet unit includes a display means for displaying a selected number of consecutive wins, a number of games won and a payoff amount; and means responsive to a selected number of consecutive wins and an amount bet by the player for displaying a payoff amount on said display means.

57. The combination of claim 56 further comprising means for presenting a flashing display when a number of games won is equal to a selected number of consecutive wins.

58. The combination of claim 54 wherein said gaming machine comprises means for generating a signal indicating a player has lost a game; and means for deleting at least one of the payoff display, games won display and selected number of consecutive wins display responsive to receipt of a signal indicating a game lost by a player when the number of games won is less than the selected number of consecutive wins.

59. The combination of claim 54 further comprising means for storing data inputted into said bet unit during use thereof.

60. The combination of claim 59 further comprising means for displaying the stored data responsive to operation of a display data switch.

61. The combination of claim 59 wherein the data stored includes the total number of games, total amount of bet, and total amount paid out; for each game, the consecutive wins selected, the amount of a bet of each game, the payoff of each win and number of games played before loss; and an identification number of the unit.

62. The combination of claim 59 further comprising means for transferring the stored data to a portable unit responsive to connection of said portable unit thereto.

* * * * *

UNITED STATES PATENT AND TRADEMARK OFFICE

CERTIFICATE OF CORRECTION

PATENT NO. : 5,788,574
DATED : August 4, 1998
INVENTOR(S) : Ornstein et al.

It is certified that error appears in the above-identified patent and that said Letters Patent is hereby corrected as shown below:

Column 4, line 16, delete "2b142b" and insert instead --2b-2b--.

Column 12, line 54, insert --PAYOFF RULES:--

Column 21, line 48, delete "firat" and insert instead --first--.

Column 21, line 55, delete "mover" and insert instead --moved--.

Signed and Sealed this

Seventh Day of March, 2000

*Attest:*

*Attesting Officer*

Q. TODD DICKINSON

*Commissioner of Patents and Trademarks*